US009215929B2

(12) United States Patent
Brunnmayr

(10) Patent No.: US 9,215,929 B2
(45) Date of Patent: Dec. 22, 2015

(54) DRIVE DEVICE FOR A MOVABLE PIECE OF FURNITURE

(71) Applicant: Julius Blum GmbH, Hoechst (AT)

(72) Inventor: Harald Brunnmayr, Hoerbranz (AT)

(73) Assignee: JULIUS BLUM GMBH, Hoechst (AT)

( * ) Notice: Subject to any disclaimer, the term of this patent is extended or adjusted under 35 U.S.C. 154(b) by 0 days.

(21) Appl. No.: 14/578,981

(22) Filed: Dec. 22, 2014

(65) Prior Publication Data

US 2015/0108891 A1 Apr. 23, 2015

Related U.S. Application Data

(63) Continuation of application No. PCT/AT2013/000102, filed on Jun. 21, 2013.

(30) Foreign Application Priority Data

Jul. 10, 2012 (AT) ..... 766/2012

(51) Int. Cl.
*A47B 88/00* (2006.01)
*A47B 88/04* (2006.01)
(Continued)

(52) U.S. Cl.
CPC ..... *A47B 88/0481* (2013.01); *A47B 88/0414* (2013.01); *A47B 88/0477* (2013.01); *A47B 88/16* (2013.01); *A47B 96/00* (2013.01)

(58) Field of Classification Search
CPC ..... A47B 88/047; A47B 88/0477; A47B 88/0481; A47B 2088/0474
USPC ..... 312/333, 334.1, 334.7, 334.8, 334.6, 312/334.44, 319.1
See application file for complete search history.

(56) References Cited

U.S. PATENT DOCUMENTS 8,714,671 B2 * 5/2014 Huang ..... 312/333
8,888,200 B2 * 11/2014 Sato ..... 312/319.1
(Continued)

FOREIGN PATENT DOCUMENTS

AT 511 964 4/2013
AT 512165 * 6/2013
(Continued)

OTHER PUBLICATIONS

International Search Report (ISR) issued Sep. 19, 2013 in International (PCT) Application No. PCT/AT2013/000102.
(Continued)

*Primary Examiner* — Janet M Wilkens
(74) *Attorney, Agent, or Firm* — Wenderoth, Lind & Ponack, L.L.P.

(57) ABSTRACT

A drive device includes an ejection element, a housing, and a locking element for the ejection element. The locking element is disposed in or on the housing and is movable relative thereto, and a detent element, which is connected to the ejection element and, in the closed position, abuts the locking element. In the locking position, the locking element can block the path of the detent element in the opening direction. The ejection element can be released both when a movable piece of furniture is subjected to increased pressure from a closed position in the closure direction and when the movable piece of furniture is pulled from the closure position in the opening direction. A detection system detects the position of the movable piece of furniture, and a transmission device transmits the position of the movable piece of furniture detected by the detection system to the locking element.

12 Claims, 21 Drawing Sheets

(51) Int. Cl.
*A47B 88/16* (2006.01)
*A47B 96/00* (2006.01)

(56) References Cited

U.S. PATENT DOCUMENTS

| | | | | |
|---|---|---|---|---|
| 8,905,497 | B2 * | 12/2014 | Bantle | 267/150 |
| 2007/0090735 | A1 | 4/2007 | Hashemi et al. | |
| 2008/0191592 | A1 | 8/2008 | Dubach | |
| 2009/0273263 | A1 * | 11/2009 | Berger | 312/334.1 |
| 2013/0134852 | A1 * | 5/2013 | Salice | 312/319.1 |
| 2013/0257245 | A1 * | 10/2013 | Gmeiner | 312/319.1 |
| 2014/0021841 | A1 * | 1/2014 | Brunnmayr | 312/319.1 |
| 2014/0210329 | A1 * | 7/2014 | Brunnmayr | 312/333 |
| 2014/0300262 | A1 | 10/2014 | Flogaus | |
| 2014/0319986 | A1 * | 10/2014 | Brunnmayr | 312/319.1 |
| 2014/0327351 | A1 * | 11/2014 | Chung | 312/333 |
| 2014/0346941 | A1 * | 11/2014 | Gasser et al. | 312/334.1 |
| 2015/0091427 | A1 * | 4/2015 | Haemmerle et al. | 312/333 |
| 2015/0097473 | A1 * | 4/2015 | Brunnmayr et al. | 312/319.1 |
| 2015/0098667 | A1 * | 4/2015 | Brunnmayr et al. | 384/21 |

FOREIGN PATENT DOCUMENTS

| | | |
|---|---|---|
| AT | 514059 | * 10/2014 |
| DE | 20 2008 000 638 | 5/2008 |
| DE | 10 2010 036 902 | 2/2011 |
| DE | 10 2013 104 886 | * 11/2014 |
| EP | 2 272 400 | 1/2011 |
| EP | 2 294 944 | 3/2011 |
| EP | 2 371 241 | 10/2011 |
| EP | 2 374 369 | 10/2011 |
| WO | 2007/028177 | 3/2007 |
| WO | 2011/015663 | 2/2011 |

OTHER PUBLICATIONS

Austrian Patent Office Search Report (ASR) issued Mar. 5, 2013 in Austrian Patent Application No. A 766/2012.

* cited by examiner

DRIVE DEVICE FOR A MOVABLE PIECE OF FURNITURE

BACKGROUND OF THE INVENTION

The invention concerns a drive device for a moveable furniture part, comprising an ejection element which acts on the moveable furniture part in the opening direction, a housing, a locking element for the ejection element, which is arranged in or on the housing and is moveable relative to the housing, and a latching element which is connected to the ejection element and which in the closed position bears against the locking element. The path of the latching element in the opening direction can be blocked by the locking element at least in the closed position of the moveable furniture part, and the ejection element can be released both upon over-pressing of the moveable furniture part from a closed position in the closing direction and also upon pulling of the moveable furniture part from the closed position in the opening direction. The drive device also includes a detection device for detecting the position of the moveable furniture part. The invention further concerns an article of furniture having such a drive device.

Various drive devices with lockable ejection devices have already been known for many years in the furniture fitting industry, in which unlocking is effected by pressing or by pulling on the moveable furniture part (drawer, flap, door or the like). By virtue of that unlocking action, the ejection element is free and can eject the moveable furniture part in the opening direction.

An example of this is to be found in Austrian patent application A 1891/2011 to the present applicant, which is published after the relevant date and which forms a prior right.

EP 2 294 944 A1 discloses a latching system in which a switching element is latched in a loop-shaped portion of a switching curve. That switching curve has a latching recess, wherein the latching recess is at least partly moveable in order to cause unlocking of the switching element when a force acts on the switching element in the opening direction. Upon unlocking of a switching element of a latching fitment, the force of at least two force storage means causes unlocking of the switching element of a second latching fitment.

Both specifications therefore disclose force-controlled triggering of the latching element or switching element. Upon movement of the moveable furniture part from the closed position in the opening direction (therefore by pulling), by way of the latching element or the switching element itself, respectively, a part of the locking element or the latching recess itself is moved against a spring force whereby the ejection element is unlocked. A disadvantage in that respect is that, in particular for unlocking by pulling, pulling has to be effected against the force of a separate force storage means.

SUMMARY OF THE INVENTION

Therefore the object of the present invention is to provide a drive device which is an alternative to the state of the art or which is improved over the state of the art.

In accordance with the invention, there is provided a transmission device which is separate from the latching element for transmission of the position of the moveable furniture part, that is detected by the detection device, to the locking portion. Upon pulling of the moveable furniture part from the closed position in the opening direction, the locking element is moveable by the transmission device. Thus at least when a pulling force is applied it is no longer the latching element itself that serves to transmit the pulling movement involving the moveable furniture part. Rather, there is provided a transmission device which is separate from the latching element and which upon pulling—depending on the respective design configuration involved, in addition upon over-pressing—unlocks the ejection element.

According to a preferred embodiment of the present invention, the detection device can be coupled to the moveable furniture part by way of an entrainment member at least in a part of the path of movement of the moveable furniture part. That coupling action should occur in particular in the path of movement of the moveable furniture part immediately prior to the closed position.

To guarantee exact detection and transmission of the position of the moveable furniture part to the locking element, the transmission device has a moveable, preferably pivotable, coupling element. Upon movement of the detection device from the closed position in the opening direction, the transmission device can be coupled to a connecting element of the detection device by way of the coupling element. If only the movement of the moveable furniture part in the opening direction is intended to have an effect on the transmission device, then preferably the coupling element should be overridable upon movement of the detection device in the closing direction by the connecting element of the detection device.

In itself locking of the latching element can be implemented by way of a frictionally locking and/or positively locking action between the latching element and the locking element. Preferably, in the housing at least partly is a preferably cardioid curve-shaped sliding track for engaging the latching element which is mounted preferably pivotably to the ejection element, wherein the locking element forms at least a part of a latching recess of the sliding track.

For a simple structural configuration, the transmission device has a transmission slide mounted moveably in or on the housing, wherein preferably the locking element is in one piece with the transmission slide. Thus, the transmission slide serves on the one hand for transmission of the movement of the moveable furniture part to the locking element, and at the same time forms a part of the latching recess of the sliding track.

In principle, besides a lockable ejection device the drive device can also have a retraction device for retraction of the moveable furniture part from an open position into the closed position. Preferably in that case, the retraction device forms a part of the detection device, in particular when the entrainment member is arranged on the retraction device. The retraction device can additionally also be damped by a damping device.

An article of furniture can include a furniture carcass, a moveable furniture part, and a drive device according to the invention for the moveable furniture part. Preferably the major part—therefore except for the entrainment member—of the drive device is associated with the moveable furniture part and engages the entrainment member which is fixed with respect to the furniture carcass by way of catch lever. However, in the reverse arrangement, the lockable ejection device can be arranged on the furniture carcass and the entrainment member can also be moveable with the moveable furniture part.

BRIEF DESCRIPTION OF THE DRAWINGS

Further details and advantages of the present invention are described more fully hereinafter by the specific description with reference to the embodiments by way of example illustrated in the drawings, in which.

DETAILED DESCRIPTION OF THE INVENTION

Figure 1:
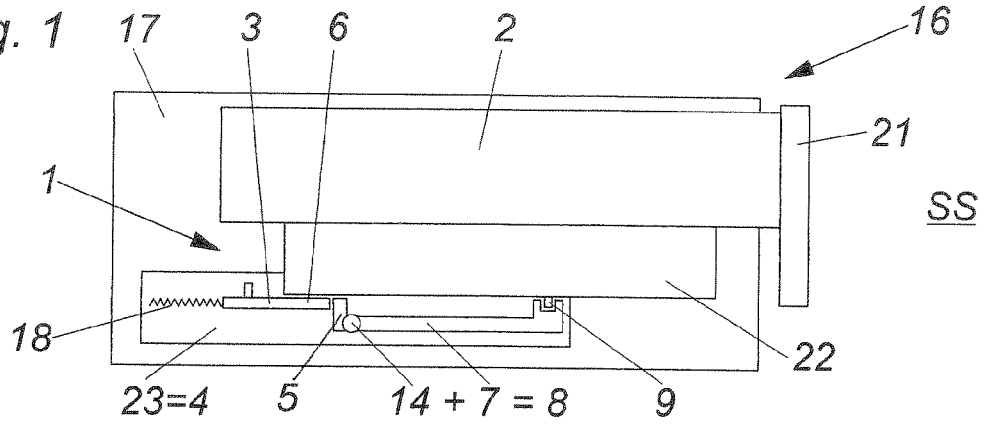
FIGS. 1 through 4 diagrammatically show a moveable furniture part in various positions with a drive device.

FIG. 1 diagrammatically shows an article of furniture 16 comprising a furniture carcass 17 and a moveable furniture part 2, at the front side of which is mounted a front panel 21. The moveable furniture part 2 is mounted moveably by way of a drawer rail 22 to a carcass rail 23—possibly also by way of a central rail (not shown). In this diagrammatic view, the carcass rail 23 at the same time forms the housing 4 of the drive device 1. In this FIG. 1, the entire drive device 1 is associated with the furniture carcass 17, only the entrainment member 9 moves with the moveable furniture part 2. In principle, the arrangement can also be precisely reversed so that the drive device 1 is associated with the moveable furniture part 2 while the entrainment member 9 is arranged fixed with respect to the furniture carcass. The position of the moveable furniture part 2—especially the entrainment member 9—is detected by way of a detection device 7 and passed to the locking element 5 by the transmission slide 14 which in this case is shown as a circle. The transmission slide 14 and the detection device 7 together with possible further components form the transmission device 8 for transmission of the position of the moveable part 2, detected by the detection device 7, to the locking element 5. The ejection element 3 (this can also be referred to as the ejection slide 3) is mounted moveably on the housing 4 and is acted upon by an ejection force storage member 18 in the opening direction OR. As the movement of the ejection element 3 in the opening direction OR is blocked by the locking element 5 the moveable furniture part 2 cannot be ejected in the opening direction OR whereby the moveable furniture part 2 is in the closed position SS.

Figure 2:
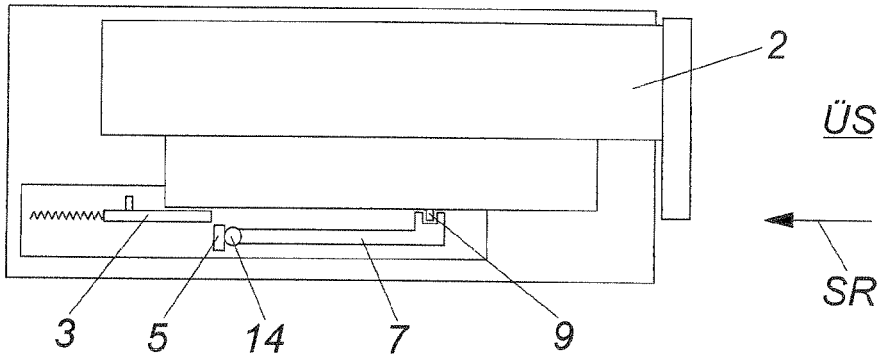

If now pressure is applied to the moveable furniture part 2 in the closing direction SR as shown in FIG. 2, the locking element 5 is moved by the transmission device 8 so that the ejection path for the ejection element 3 is cleared. In the event of over-pressing in the closing direction SR, the locking element 5 does not necessarily have to be moved, as in FIGS. 1 through 4 and FIGS. 23 through 29. Rather, the position of the moveable furniture part 2 can be passed by the detection device 7 directly to the ejection element 6 arranged on the ejection element 3 so that it is moved out of the latching recess 13 of a cardioid curve-shaped sliding track 12 into an opening portion 45 of the sliding track 12, as shown in FIGS. 5 through 22. The over-pressed position US is reached by that over-pressing action.

Figure 3:
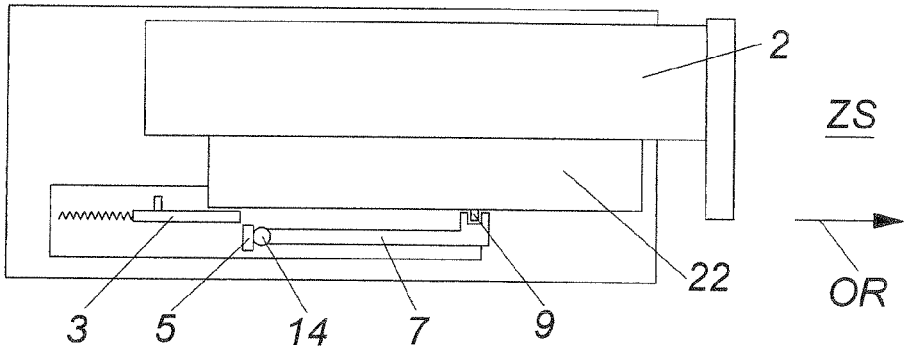

In comparison, FIG. 3 shows a drive device 1 which is unlocked by pulling on the moveable furniture part 2 in the opening direction OR. That opening movement is also detected by the detection device 7 whereby the locking element 5 is moved relative to the housing 4 by a transmission device 8 separate from the latching element 6 and thereby clears the ejection path for the ejection element 3. The pulling position ZS which is directly in front of the closed portion SS is reached thereby.

Figure 4:
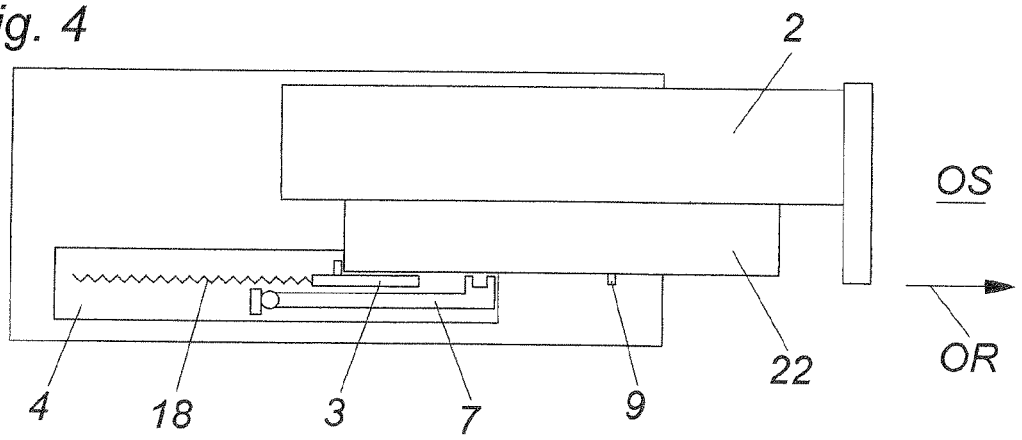

In FIG. 4, the ejection element 3, after unlocking thereof by pressing (as shown in FIG. 2) or by pulling (FIG. 3), due to the ejection force storage 18 being relieved of stress, has ejected the moveable furniture part 2 in the opening direction OR, whereby an open position OS is reached. Upon ejection the entrainment member 9 comes out of engagement from the detection device 7. That can be effected by the catch lever 37 of the detection device 7 being pivoted away.

Figure 5:
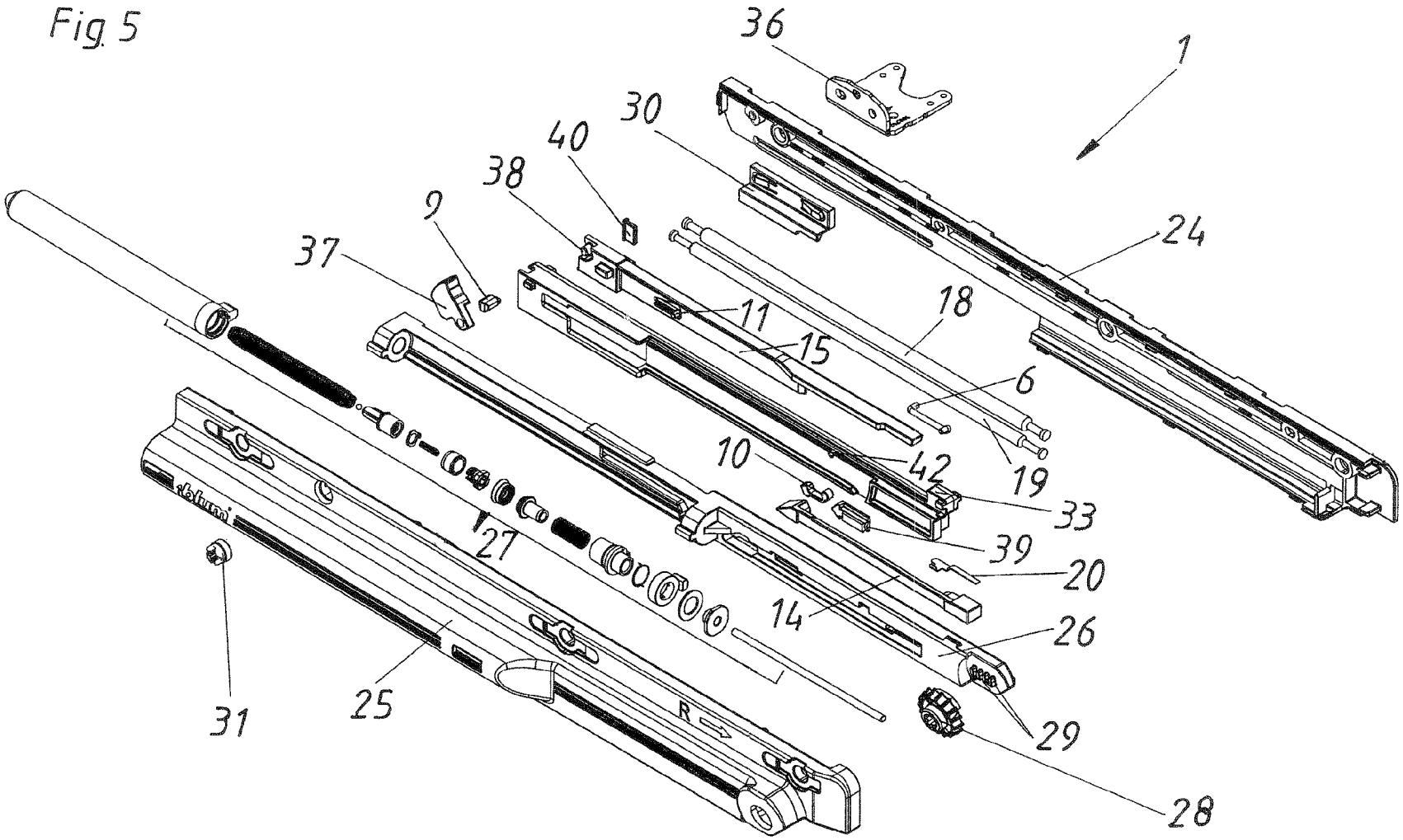
FIGS. 5 through 6 are exploded views of a drive device.
Figure 6:
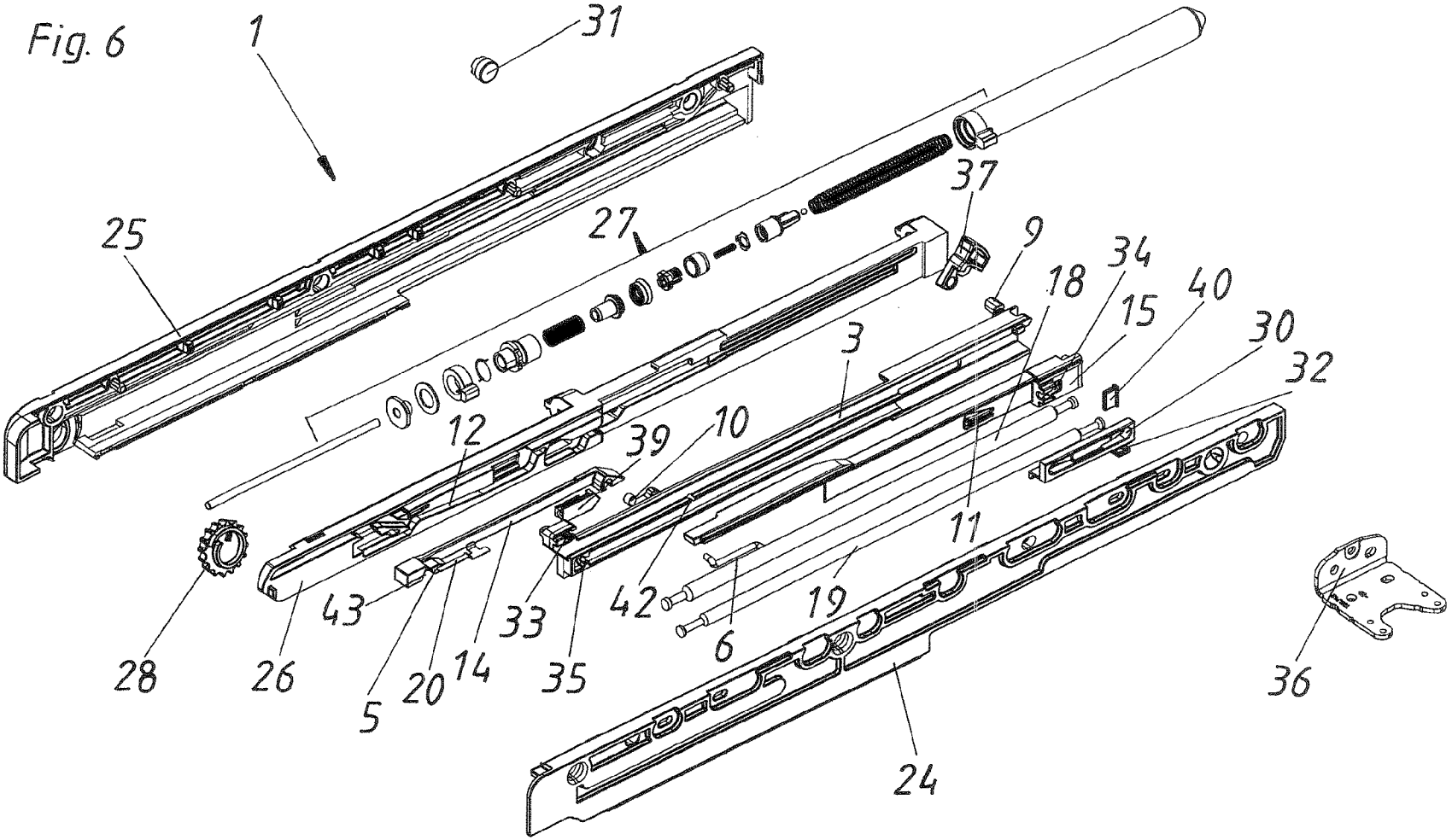

Exploded views of a specific embodiment by way of example of a drive device 1 are shown in FIGS. 5 and 6. In that case, the housing base plate 24, the housing center plate 26 and the housing cover 25 together form the housing 4, and the housing 4 is preferably mounted to a drawer rail 22 by the housing base plate 24. To achieve a change in position of the moveable furniture part 2 in its closed position SS relative to the furniture carcass 17, the housing center plate 26 can be displaced relative to the components fixed with respect to the furniture part, the housing base plate 24 and the housing cover 25. In that case, precise setting is possible by the adjusting member 28 and the adjusting studs on the housing center plate 26. A damping device 27 for damping the retraction movement of the moveable furniture part 2 is also connected to the housing center plate 26. The individual components of that damping device 27 are not identified in greater detail.

The sliding track 12 in which the latching element 6 moves is provided in the housing center plate 26 and thus in the housing 4. The latching element is held pivotably at one end at the mounting location 42 in the ejection element 3. The ejection element 3 is moveable between abutments relative to the housing center plate 26. The spring base 33 for the ejection force storage member 18 (tension spring) is provided on that ejection element 3. The other end of the ejection force storage member 18 is held to the spring base 32. That spring base 32 is disposed at the spring stressing element 30 fixedly connected to the housing base plate 24. The spring stressing force can be adjusted in dependence on the location of fixing of the spring stressing element 30 to the housing base plate 24. The spring stressing element 30 arranged on the housing base plate 24 can be moved relative to the housing base plate 24 by way of the adjusting element 31 and thus the spring stressing force of the ejection force storage member 18 can be adjusted.

A spring base 35 for the retraction force storage member 19 (tension spring) is also disposed on the ejection element 3, the retraction force storage member being fixed on the other hand to the spring base 34 on the retraction slide 15. That retraction slide 15 (it can also be referred to as the retraction device 15) is mounted to the ejection slide 3 moveably limitedly by abutments. At one end of the retraction slide 15 is disposed the axis of rotation 38 for the catch lever 37. The entrainment member 9 is held by way of that catch lever 37—which is part of the detection device 7. The entrainment member 9 is fixedly connected to the mounting plate 36 which is mounted to the carcass rail 23 (not shown). A damping abutment 40 is also provided at the end of the retraction slide 15 so that upon contact occurring between the retraction slide 15 and the entrainment member 9 no loud noise occurs and the components are handled gently.

The transmission slide 14 mounted moveably on the housing center plate 26 is provided for travel-controlled triggering of the ejection slide 3 or for travel-controlled nullification of the locking action upon pulling on the moveable furniture part. At one end, the slide 14 has the locking element 5 which in part also forms the latching recess 13 of the sliding track 12. The inclined deflection member 43 which also forms the sliding track 12 for the over-pressing effect is also provided on that transmission slide 14. The elastic coupling element 10 is held at the front end of the transmission slide 14, the coupling element 10 corresponding to the connecting element 11 provided on the retraction slide 15. Also arranged on the transmission slide 14 is the deflection element 20, by way of which the latching element 6 can be moved back into the closed position SS in the event of the ejection movement not being complete. The slider 39 which is mounted resiliently on the housing center plate 26 serves to provide that the latching element 6 does not pass into an unwanted portion of the sliding track 12, in particular when the drawer is thrown shut with too little energy and is ejected again before locking takes place. In such a movement the slider 39 remains closed.

Figure 7:
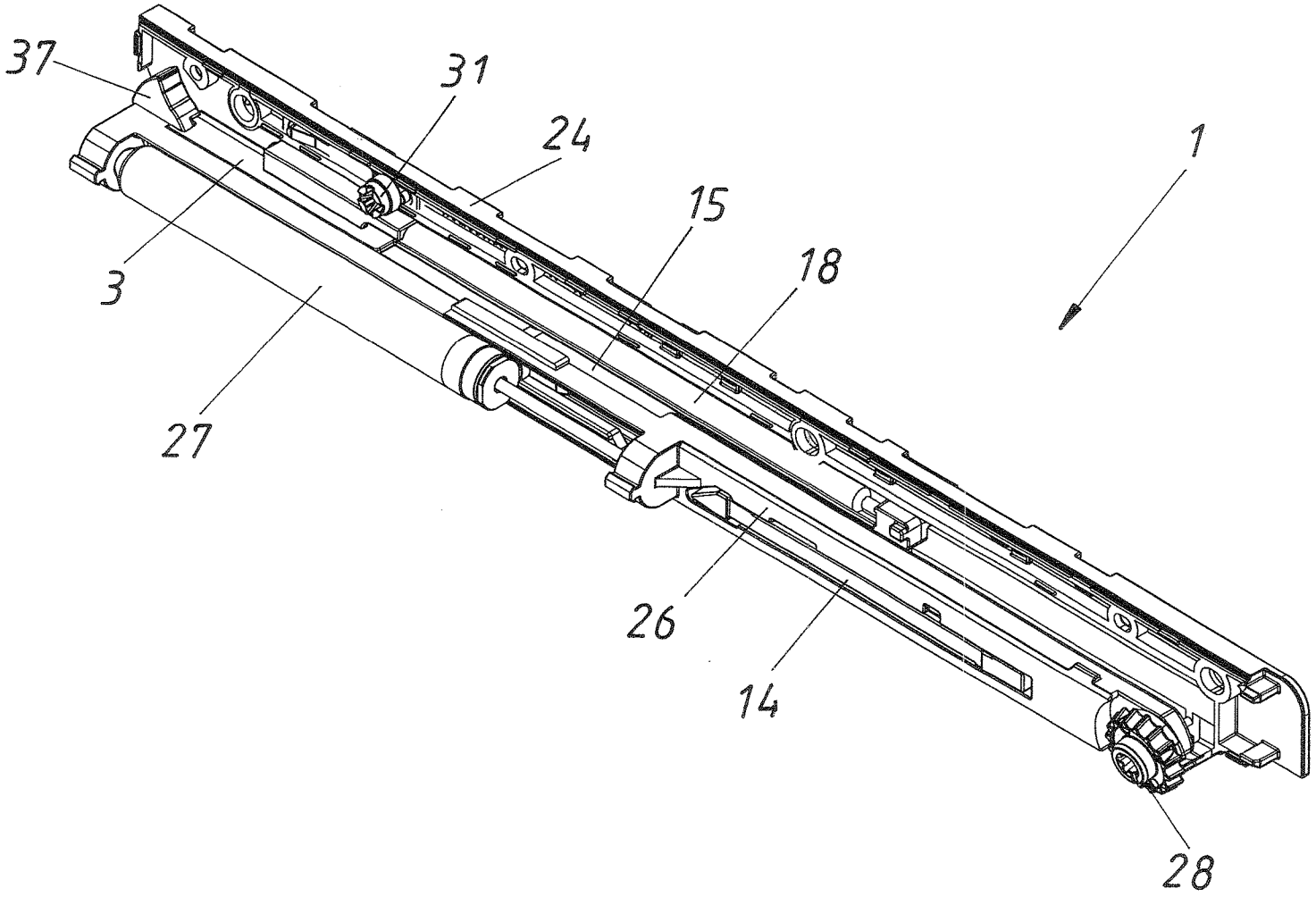
FIGS. 7 through 12 are various broken-away 3D views of the drive device.

FIG. 7 shows the drive device 1 in the assembled condition, with the housing cover 25 removed. It will be seen that the damping device 27 is clamped in the housing center plate 26. It is also possible to see the ejection force storage member 18 which is fixed on the one hand to the housing base plate 24 or to the spring stressing element 30 and on the other hand to the ejection slide 3. The retraction slide 15 and the catch lever 37 fixed thereto can also be partly seen. The large part of the transmission slide 14 is also visible through the housing center plate 26.

Figure 8:
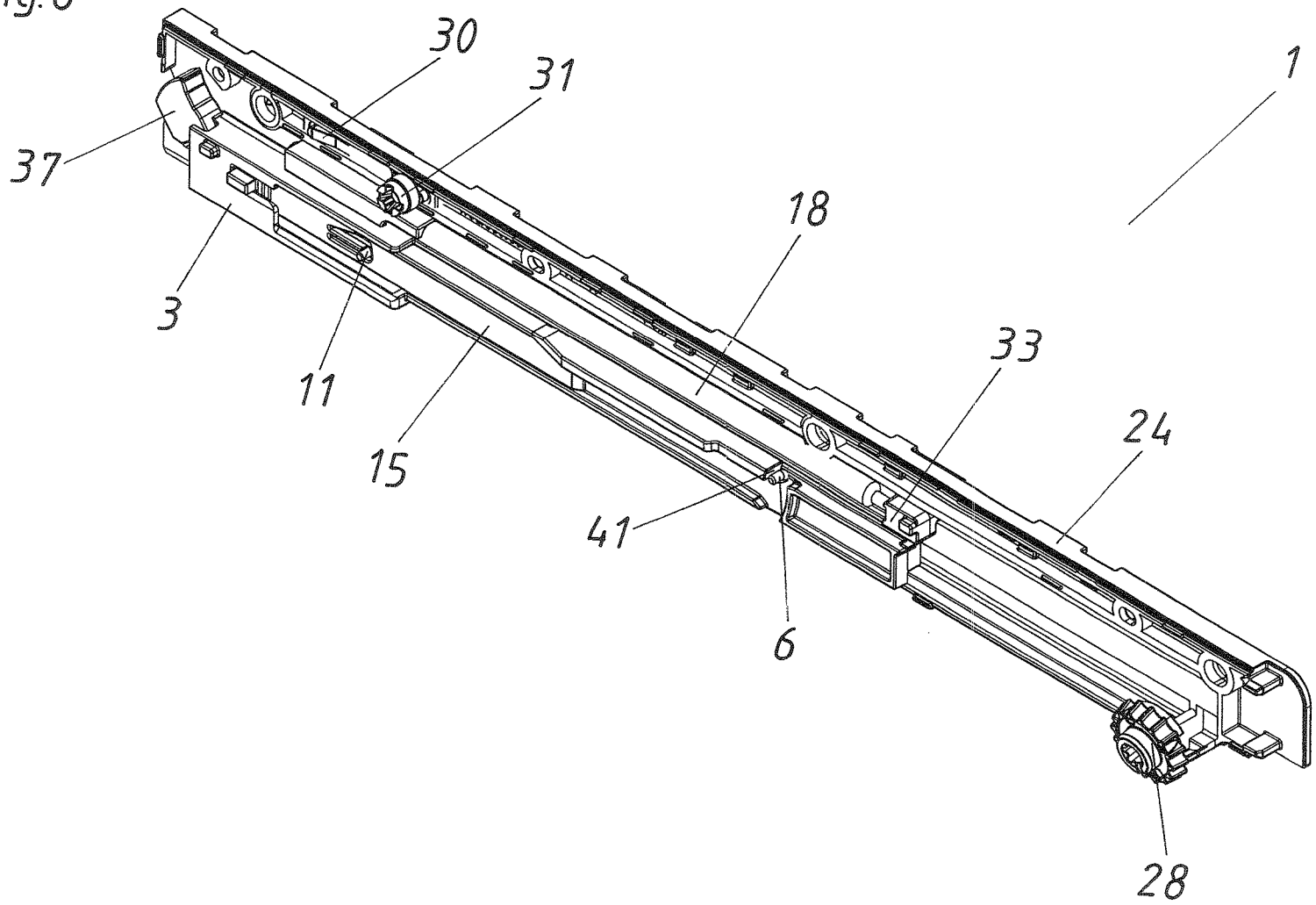

The housing center plate 26 is removed in FIG. 8 in comparison with FIG. 7, thereby ensuring a better view of the ejection slide 3 and the retraction slide 15.

It will be seen that the latching element 6 bears against an end of the retraction slide 15—which is formed by the latching element abutment 41. The latching element 6 cannot escape from that position as it is guided in the sliding track 12.

Figure 9:
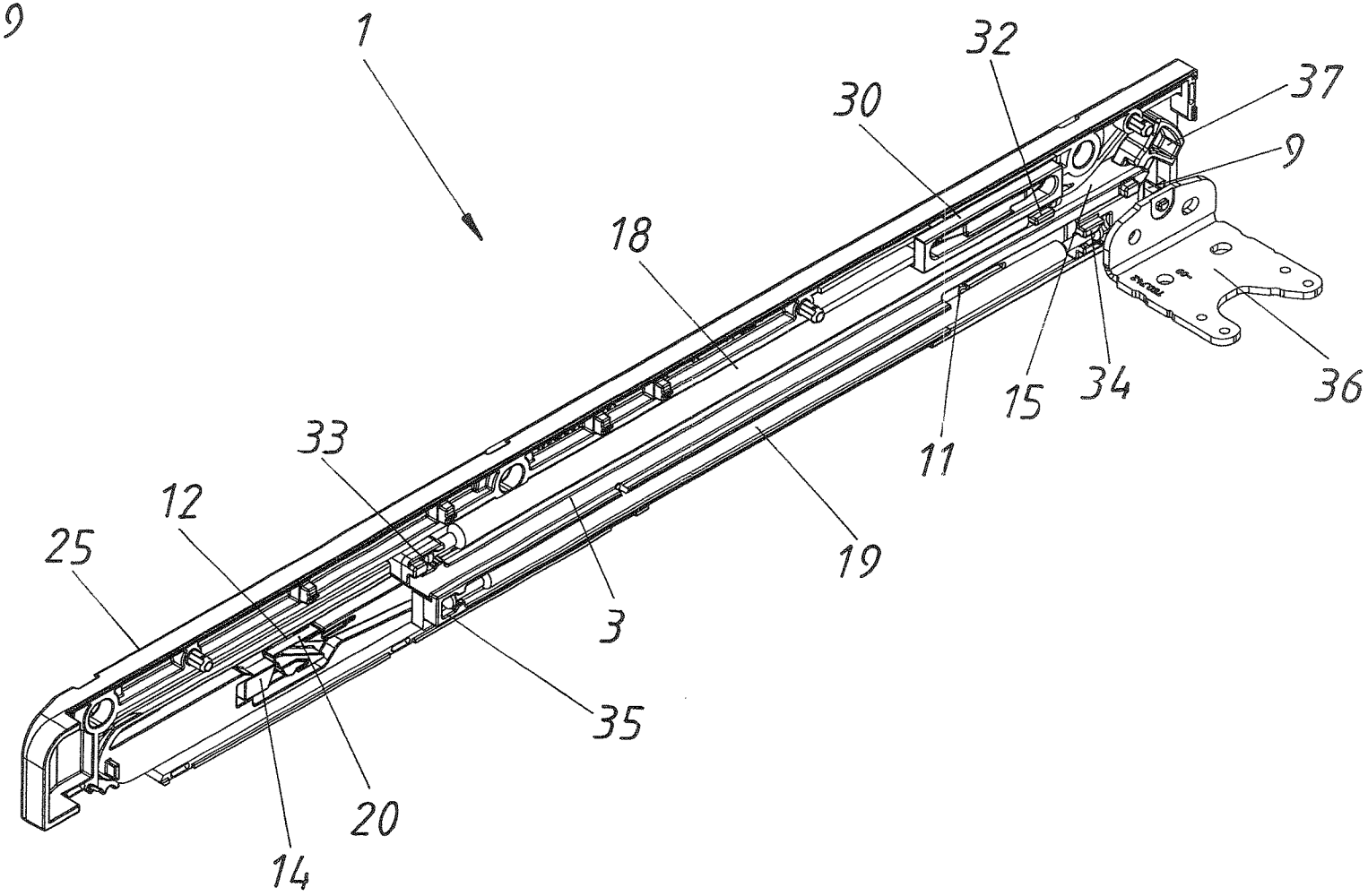

That sliding track 12 is visible for the major part in FIG. 9 in which, of the drive device 1, only the housing base plate 24 is missing. The retraction force storage member 19 which is in the form of a tension spring is in this case held between the spring bases 34 and 35. The ejection force storage member 18 is held to the spring bases 32 and 33. The catch lever 37 is shown in the opened position, wherein the entrainment member 9 already bears against the abutment 40 of the retraction slide 15.

Figure 10:
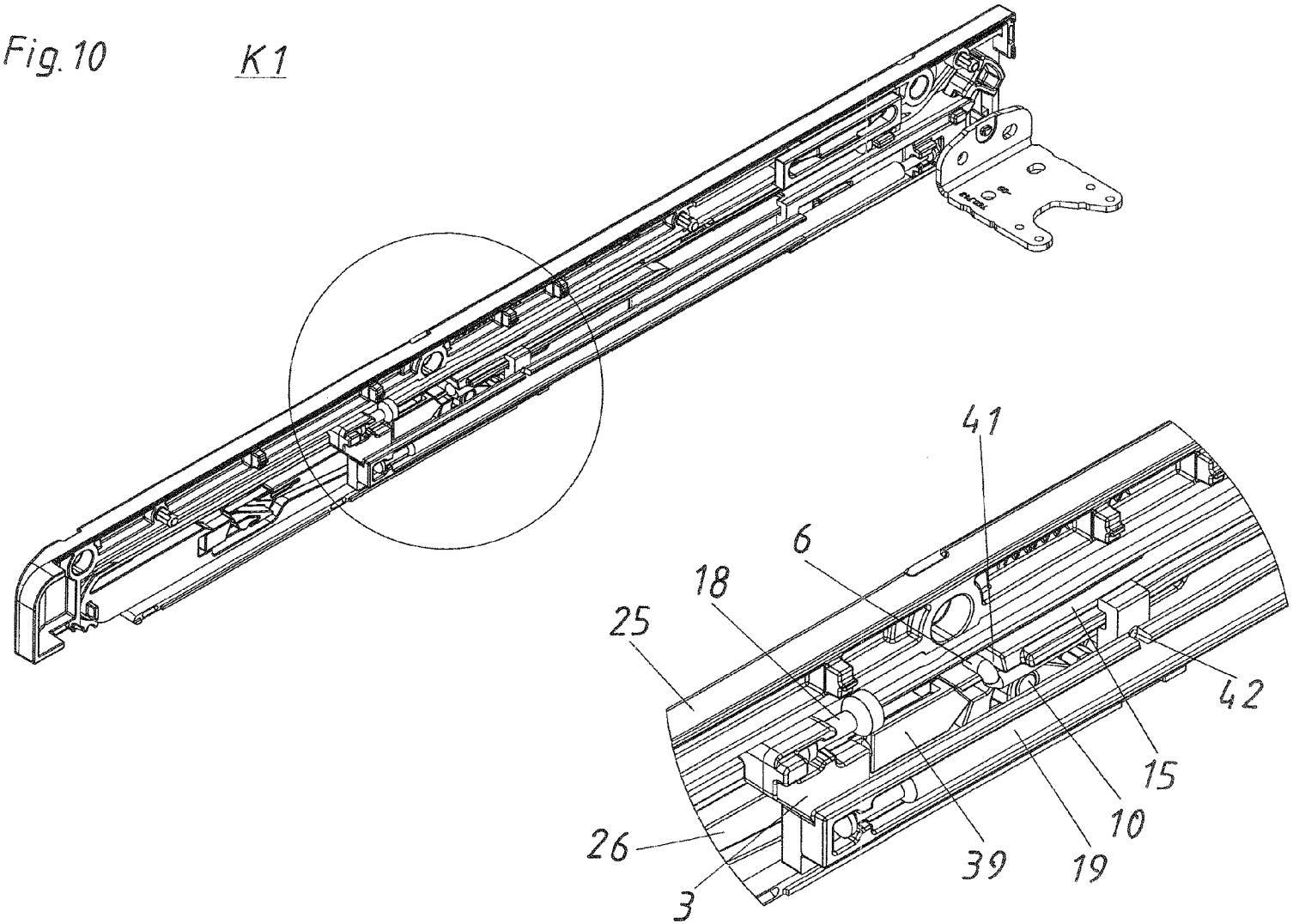

To give a better view in relation to the latching element 6, a part of the ejection slide 3 is removed in FIG. 10 in contrast to FIG. 9. As a result, it can be seen that the latching element 6 bears against the sliding track 12 and the latching element abutment 41. In this first coupling position K1 of the latching element 6, the retraction slide 15 is coupled to the ejection slide 3 as the retraction slide 15, by virtue of the latching element abutment 41 bearing against the latching element 6, cannot move further towards the left relative to the ejection slide 3. As a result, the retraction force storage member 19 cannot be relieved of stress.

Figure 11:
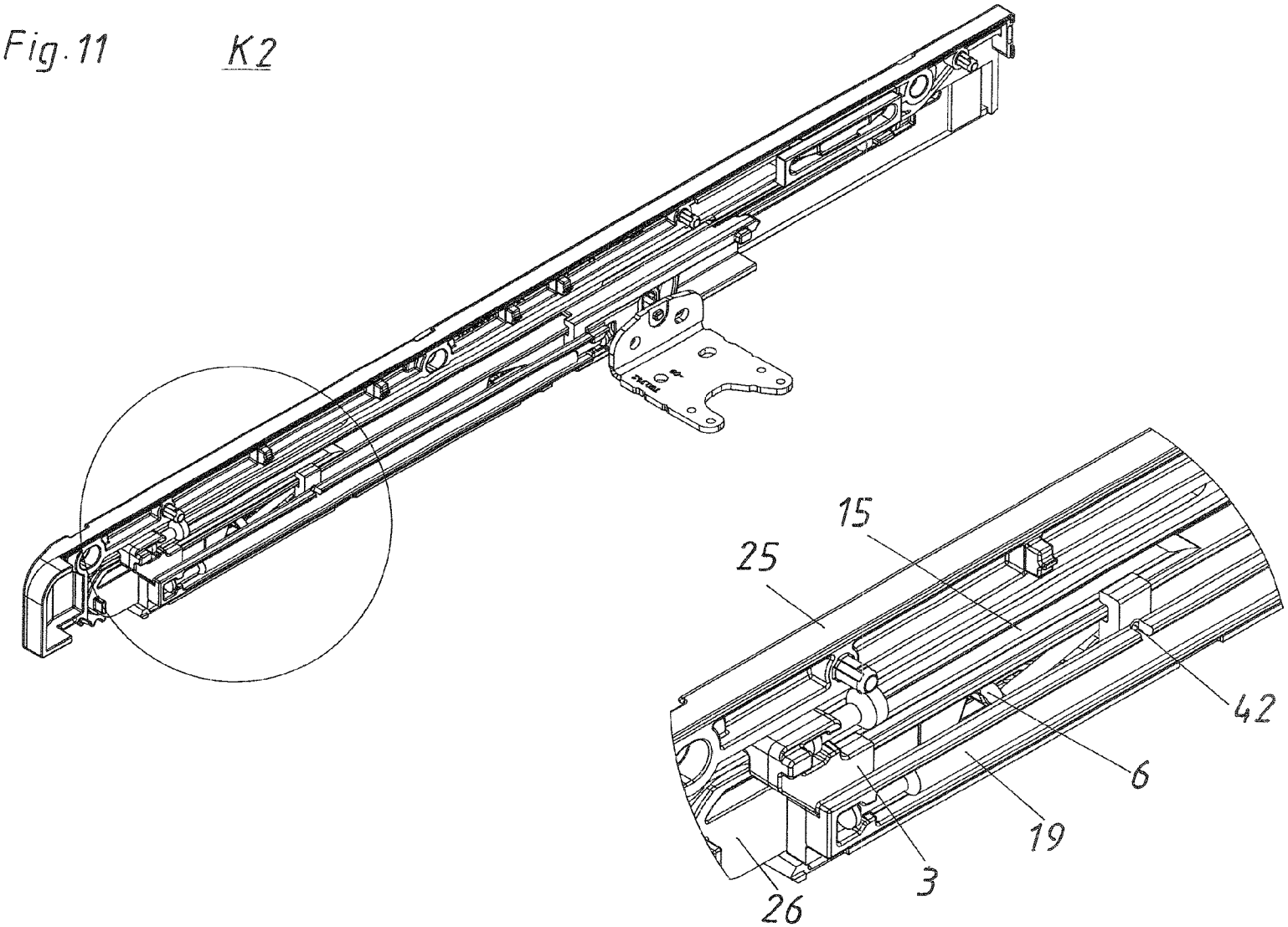

In contrast, in FIG. 11 the retraction force storage member 19 is relaxed as the latching element 6 has reached the second coupling position K2 in which the path for the retraction slide 15 relative to the ejection slide 3 has been cleared.

Figure 12:
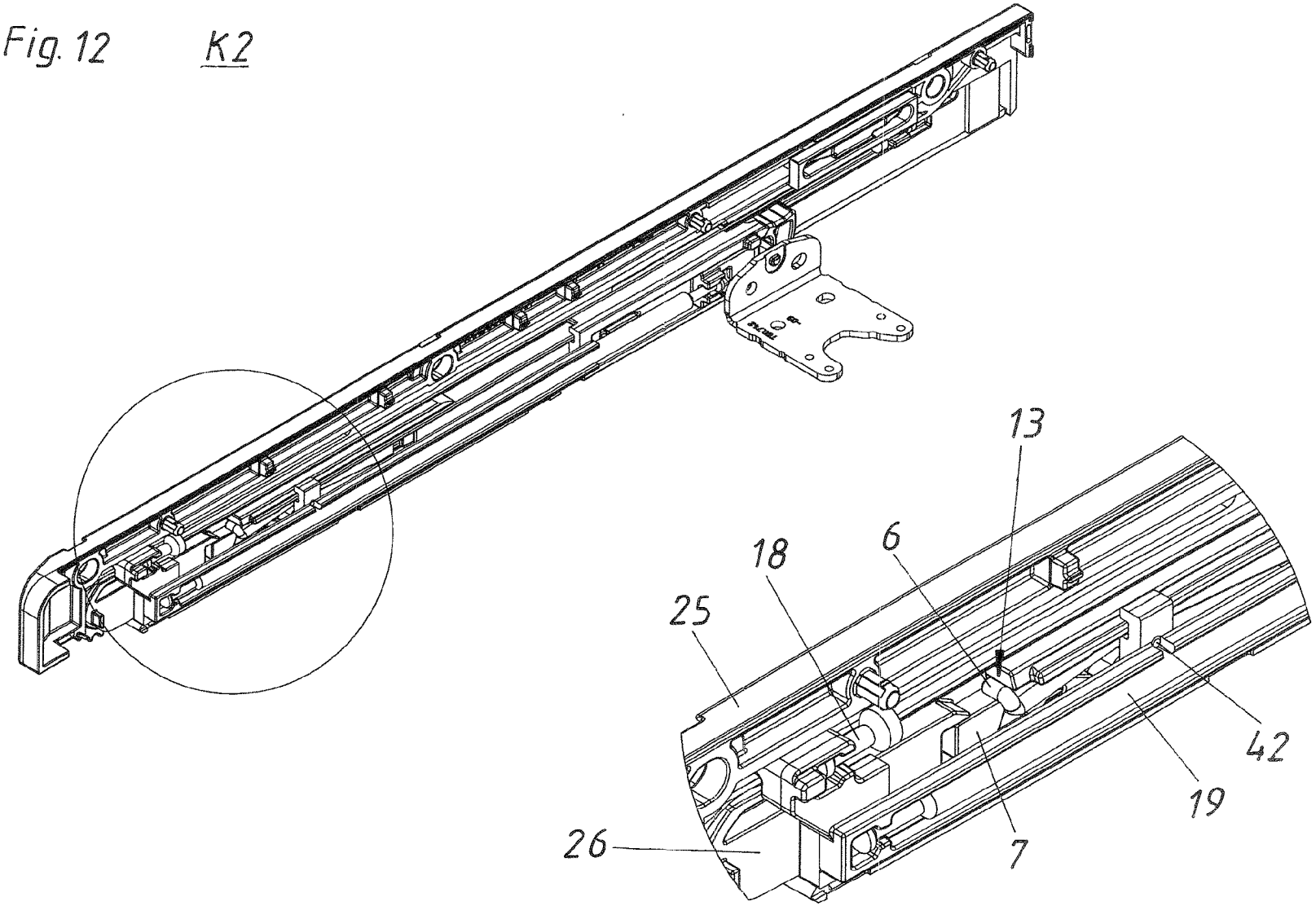

In conformity therewith the retraction slide 15 is partly removed in FIG. 12 so that there is a clear view to the latching element 6 held in or on the latching recess 13.

Figure 13:
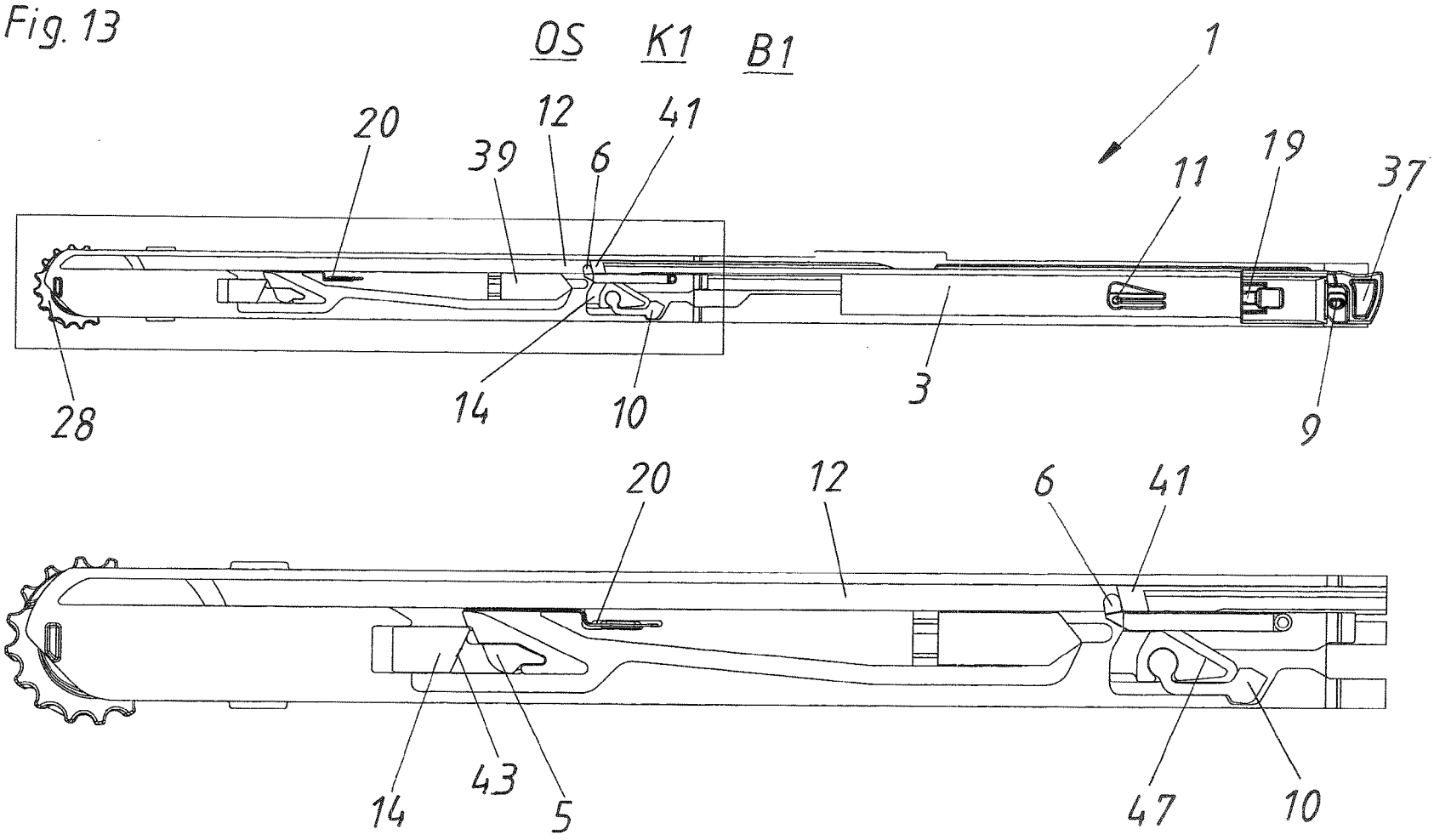
FIGS. 13 through 19 show the movements involved in closing and unlocking by over-pressing.

In FIG. 13, the drive device 1 and thus the moveable furniture part 2 are disposed in the open position OS. Similarly to FIG. 10, the latching element 6 bears against the latching element abutment 41 of the retraction slide 15 and is guided in the sliding track 12 provided in the housing center plate 26. The entire ejection slide 3 is disposed in a first movement portion B1 and the latching element 6 is disposed in the first coupling position K1. The connection to the entrainment member 9 can be seen at the other end of the retraction slide 15, by way of the catch lever 37. Partially concealed by the housing center plate 26 the transmission slide 14 is arranged moveably relative to the housing center plate 26. That transmission slide 14 also forms parts of the sliding track 12. Thus, the transmission slide for example has the locking element 5 and the inclined deflection member 43 for the latching element 6 and the inclined guide member 47 for the connecting element 11. In addition, the coupling element 10 which can correspond to the connecting element 11 is mounted pivotably to the transmission slide 14.

When the moveable furniture part 2 is further moved in the closing direction SR in FIG. 13 then the latching element 6 moves along the sliding track 12 which is partly formed by the deflection element 20, while retaining the first coupling position K1. The end of the straight closing portion of the sliding track 12 and thus the end of the first movement portion B1 are reached in FIG. 14.

Figure 14:
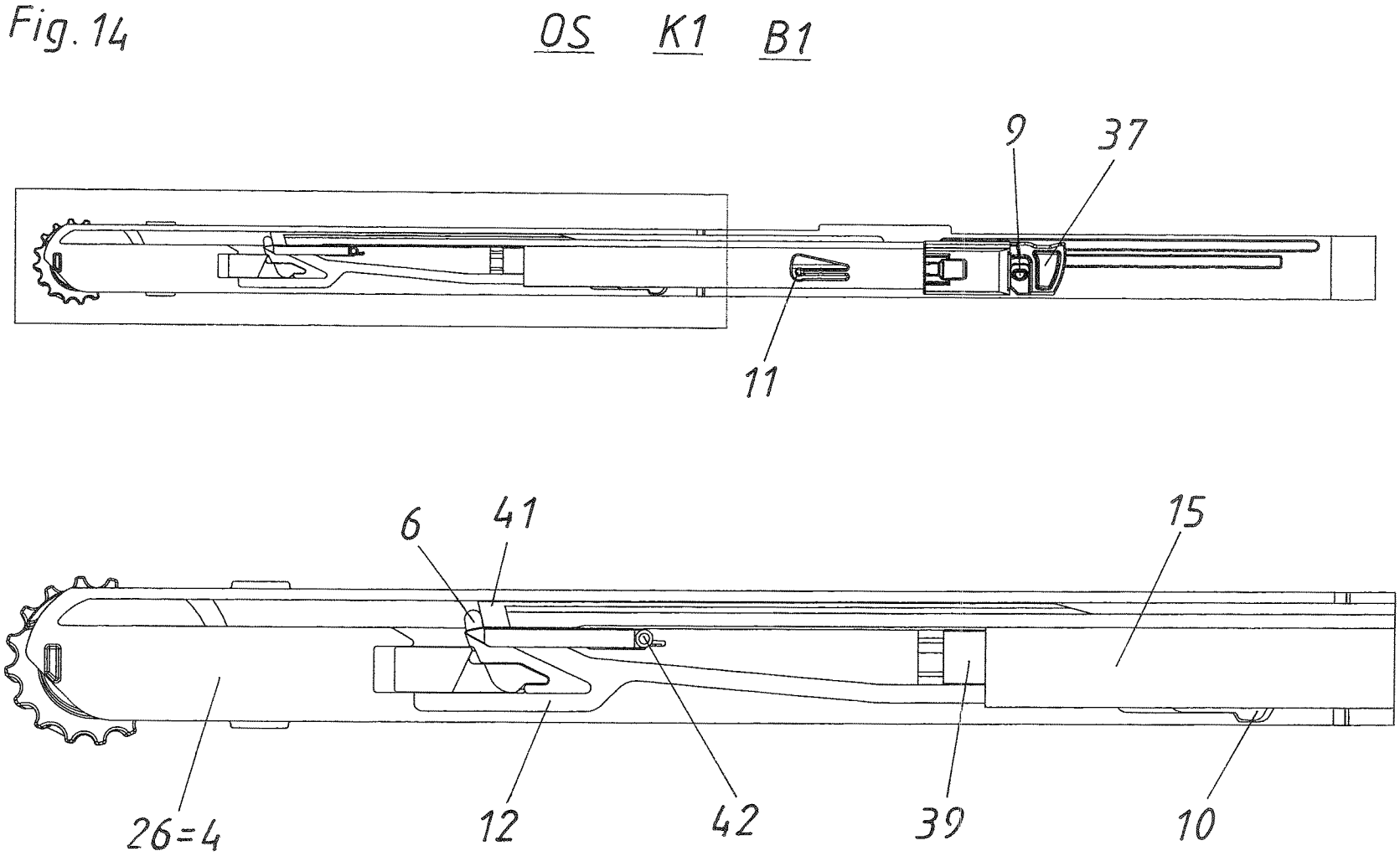
Figure 15:
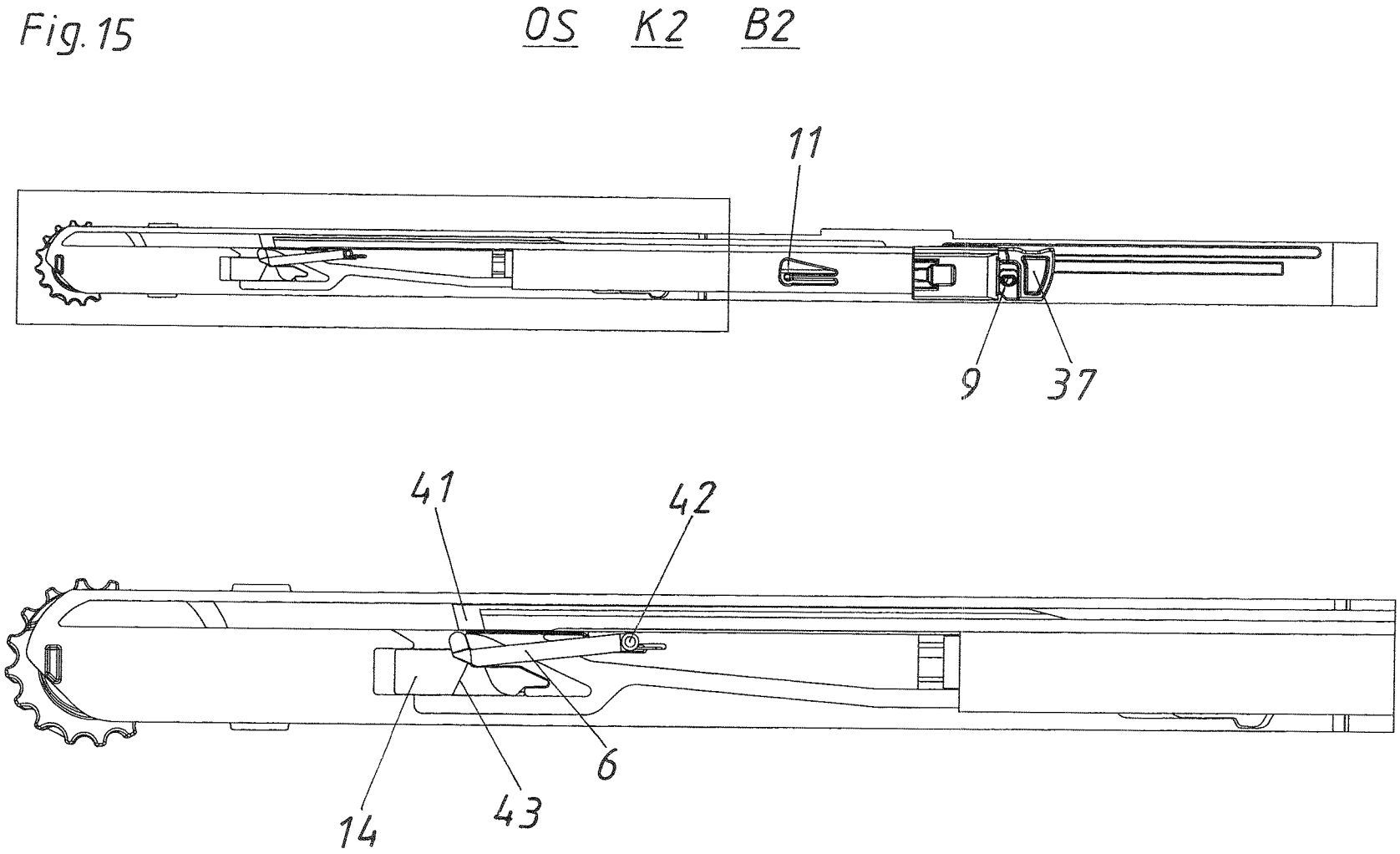

As soon as the moveable furniture part 2 is further moved from the position in FIG. 14 into the position shown in FIG. 15, the latching element 6 is urged by the latching element abutment 41 of the retraction slide 15 into the latching recess of the sliding track 12. As a result, the retraction slide 15 is uncoupled from the ejection slide 3 and at the same time the ejection slide 3 is locked to the housing 4 and the second coupling position K2 is reached. Thus two coupling operations are implemented by that one movement of the latching element 6.

Figure 16:
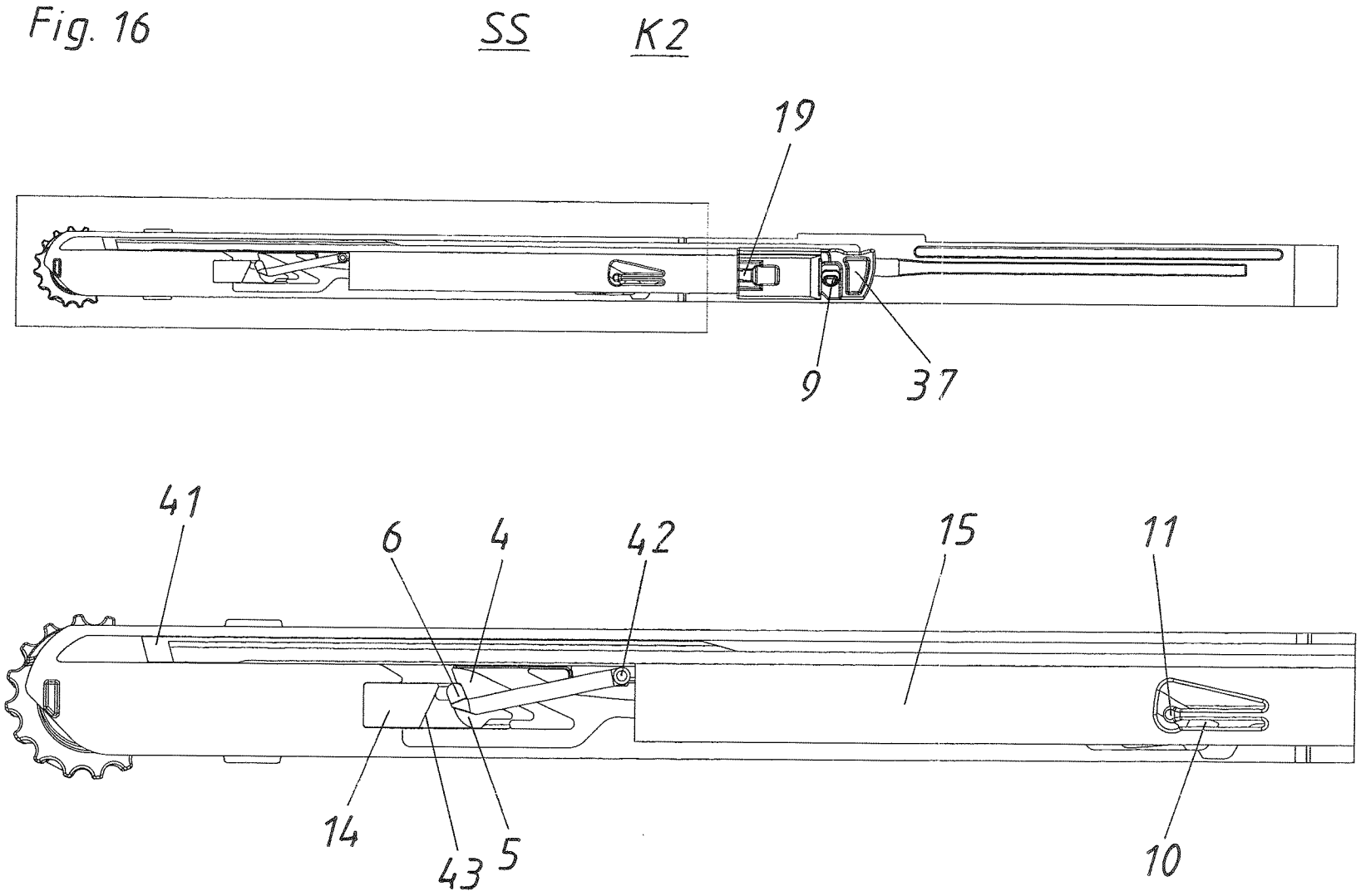

The moveable furniture part is moved or retracted from the open position OS in FIG. 15 into the closed position SS in FIG. 16 by stress relief of the retraction force storage member 19. As soon as the connecting element 11 bears against the coupling element 10 of the transmission slide 14 just before the end of that retraction movement, the entire transmission slide is firstly moved towards the left to the abutment in the housing center plate 26. After that, the connecting element 11 passes over the coupling element 10 in the closing direction SR. With that, movement towards the left of the transmission slide 14 its locking element 5 is also moved towards the left and, together with a part of the sliding track 12 provided on the housing 4 (more specifically in the housing center plate 26), forms the actual latching recess 13 for the latching element 6 in the housing 4. The latching element thus remains in the second coupling position K2, even if slightly displaced in relation to FIG. 15. It can be clearly seen from FIG. 16 that the sliding track 12 now has a cardioid shape.

Figure 17:
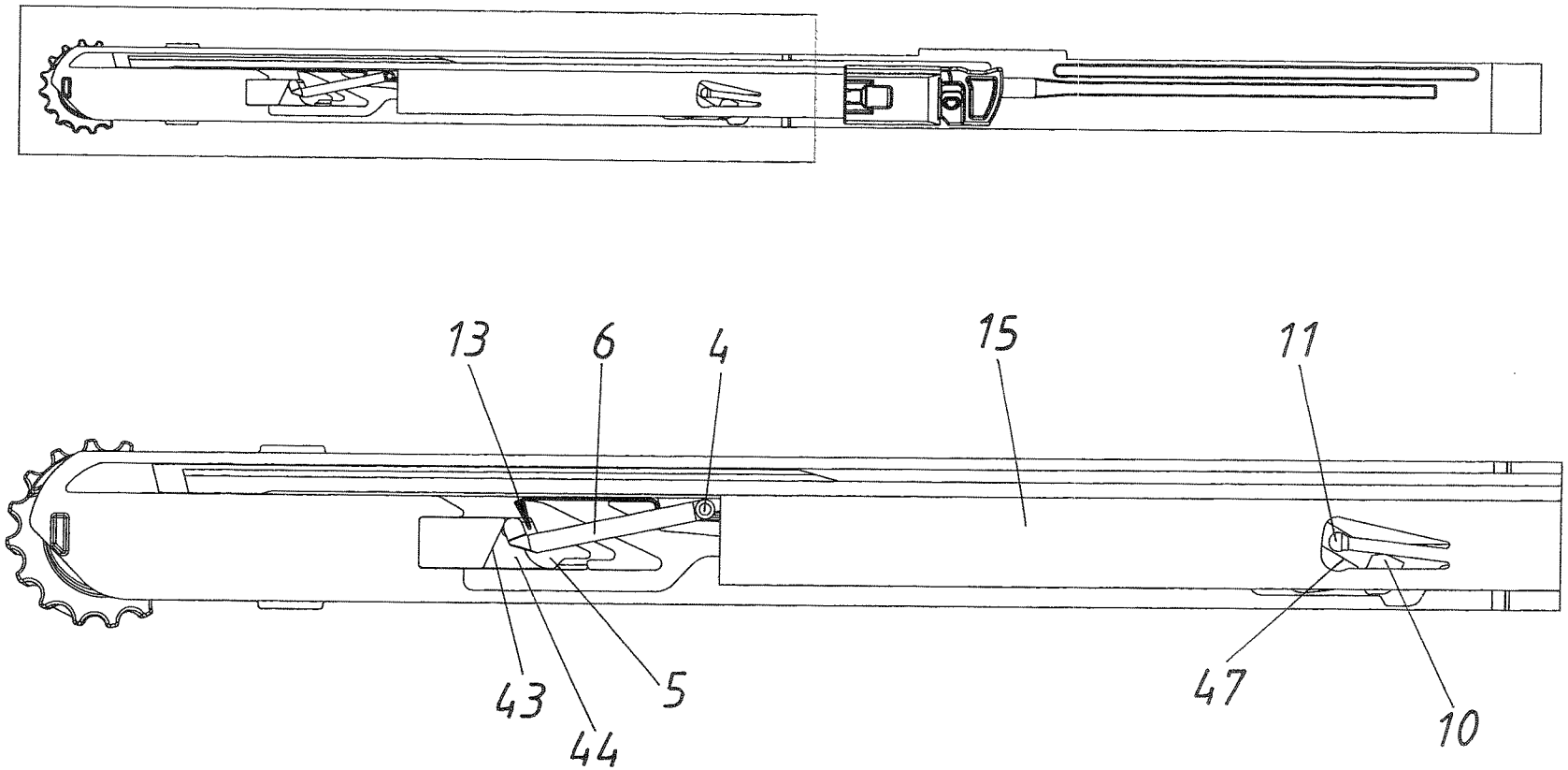
Figure 18:
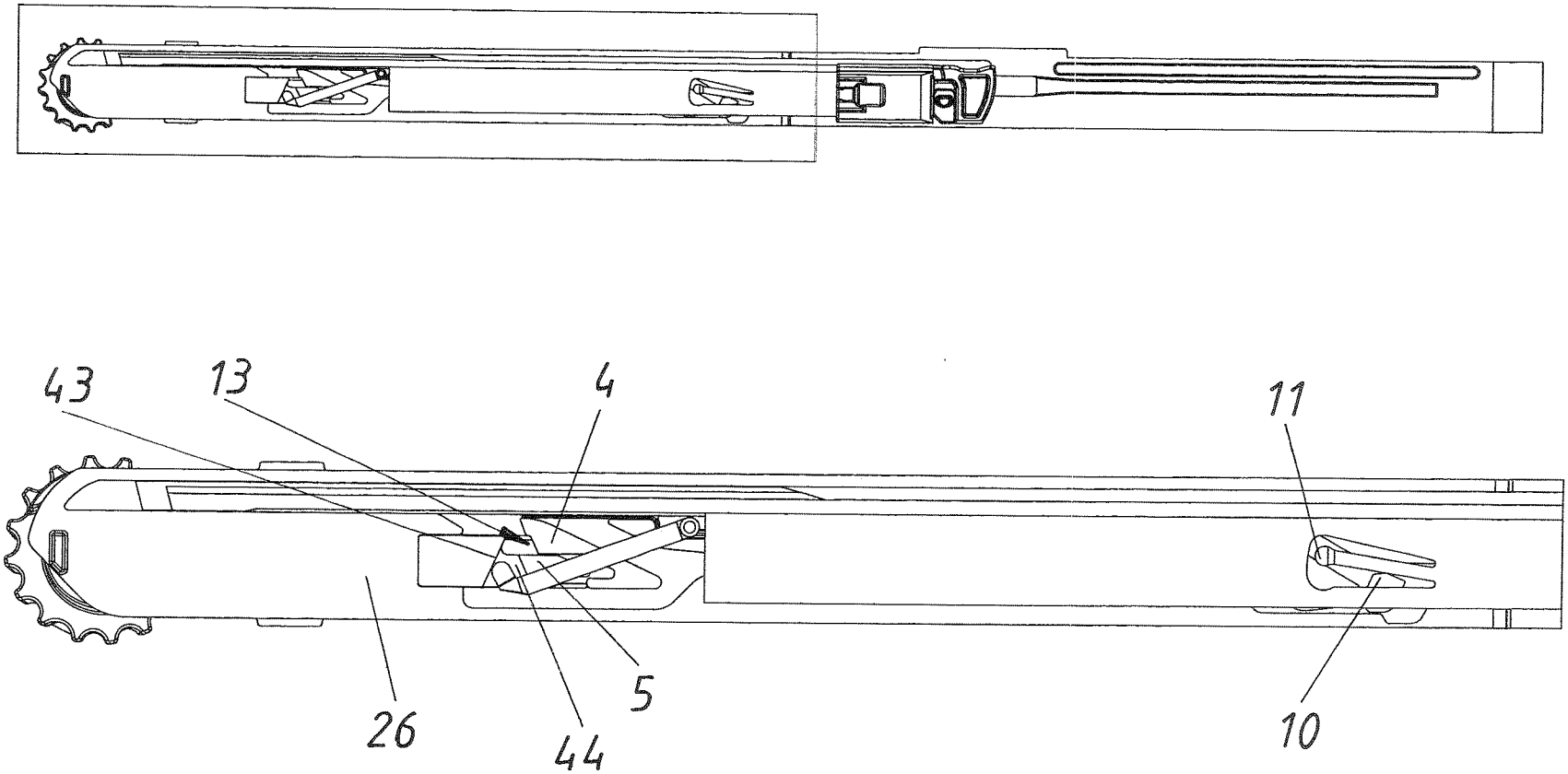

If pressure is applied to the moveable furniture part 2 in the closing direction SR in that closed position SS (see FIG. 17), the retraction slide 15 is also further moved in the closing direction SR. As that retraction slide 15 has reached an end abutment at the ejection slide 3 in that closed position SS, the ejection slide 3 is also moved in the closing direction SR together with the latching element 6 mounted pivotably thereto. As a result, the latching element 6 moves as shown in FIG. 17 out of the latching recess 13 until the latching element bears against the inclined deflection member 43. The overpressed position US is reached thereby. At the same time the connection element 11 is also deflected by the inclined guide member 47.

Due to deflection at the inclined deflection member 43 (see FIG. 18) the latching element 6 further passes through the depression 44 provided in the transmission slide 14 and forming a part of the sliding track 12, in the direction of the opening portion 45 of the sliding track 12.

Figure 19:
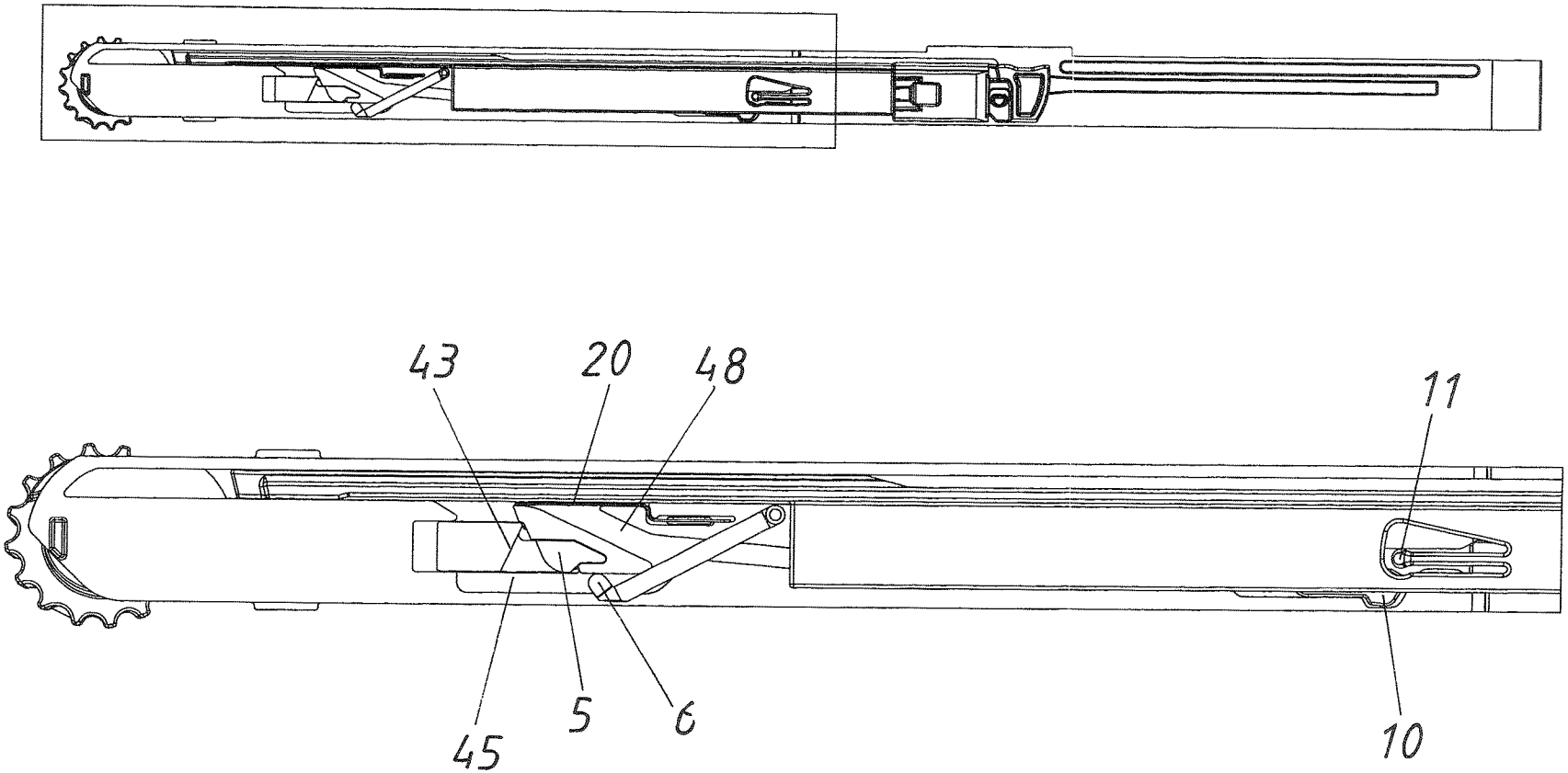
Figure 20:
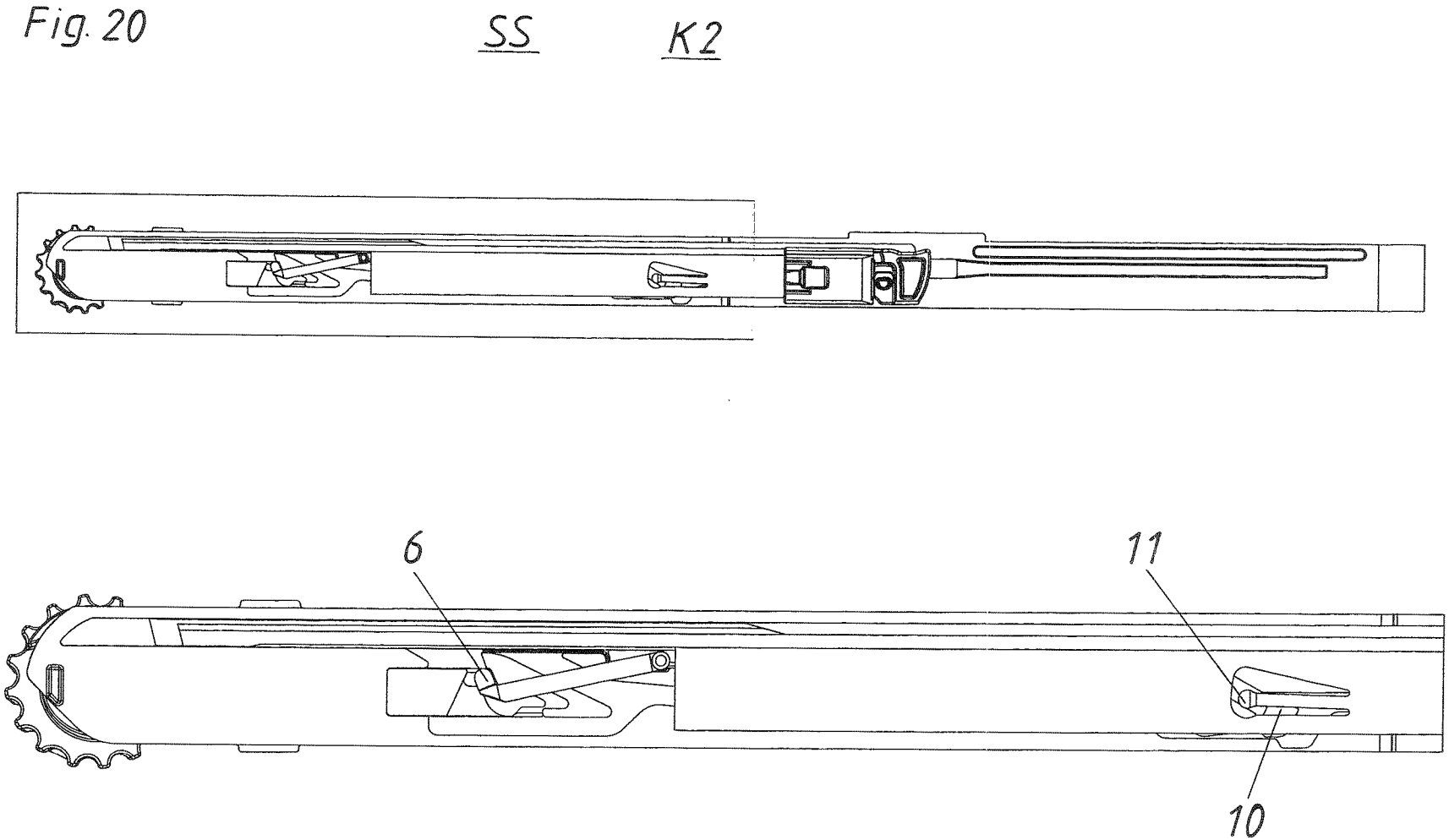
FIGS. 20 through 22 show the movements involved in unlocking by pulling.

As soon as that opening portion 45 is reached, the ejection element 3 is unlocked and the ejection force storage member 18 can be relieved of stress and the moveable furniture part 2 is ejected in the opening direction OR and passes into the open position OS (see FIG. 19). In that ejection movement the transmission slide 14 is moved again by the connecting element 11 by way of the coupling element 10 until reaching a condition of abutment a distance in the opening direction OR so that the initial position of the transmission slide 14 is restored. If the opening movement should already be interrupted shortly after the start, then upon re-closing, the latching element 6 can move through the deflection passage 48 and the latching element 6 passes into the closing portion of the sliding track 12 again, due to the deflection element 20 having a flap configuration being urged away.

FIG. 20 again shows the closed position SS in which the latching element 6 is in the second coupling position K2. That FIG. 20 corresponds to the view in FIG. 16.

Figure 21:
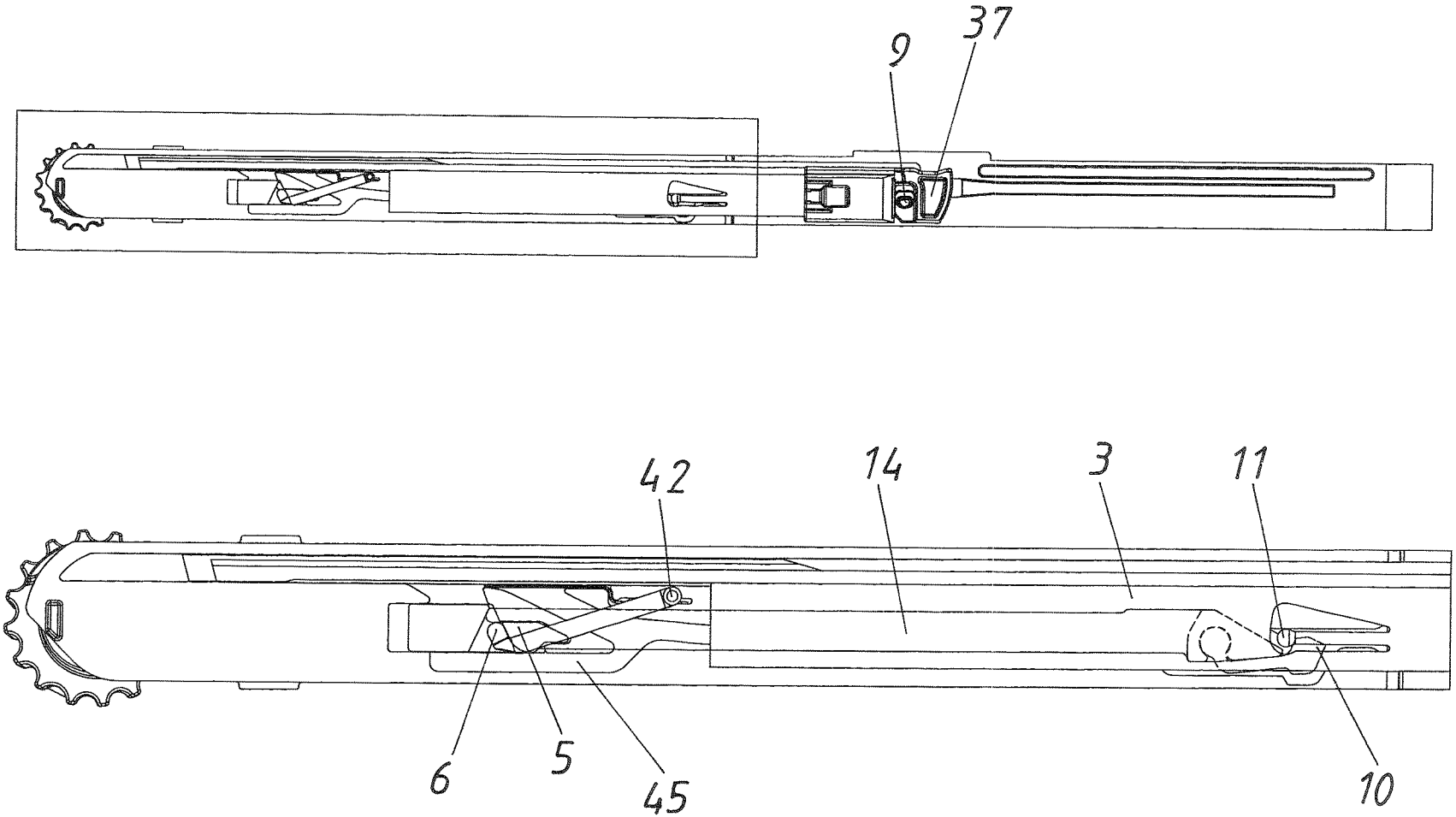

If now pressure is not applied to the moveable furniture part 2 from that closed position SS but a pulling force is applied to the moveable furniture part 2, that movement is detected by the detection device 7—which is formed by the catch lever 37 and the retraction slide 15. As a result, the retraction slide 15 and therewith the connecting element 11 are moved towards the right until it bears against the coupling element 10 and entrains it. Due to the coupling element 10 being entrained in that way, as shown in FIG. 21, the entire transmission slide 14 is also moved and the locking element 5 no longer forms a part of the latching recess 13. In that way, the path for the latching element 6 is no longed blocked by the locking element 5 and the path into the opening portion 45 of the sliding track 12 is clear. Accordingly, transmission of the pulling movement is not effected directly to the latching element 6, but so-to-speak the latching abutment (=locking element 5) is drawn away from that latching element 6 and thus the locking position or the second coupling position K2 is nullified.

Figure 22:
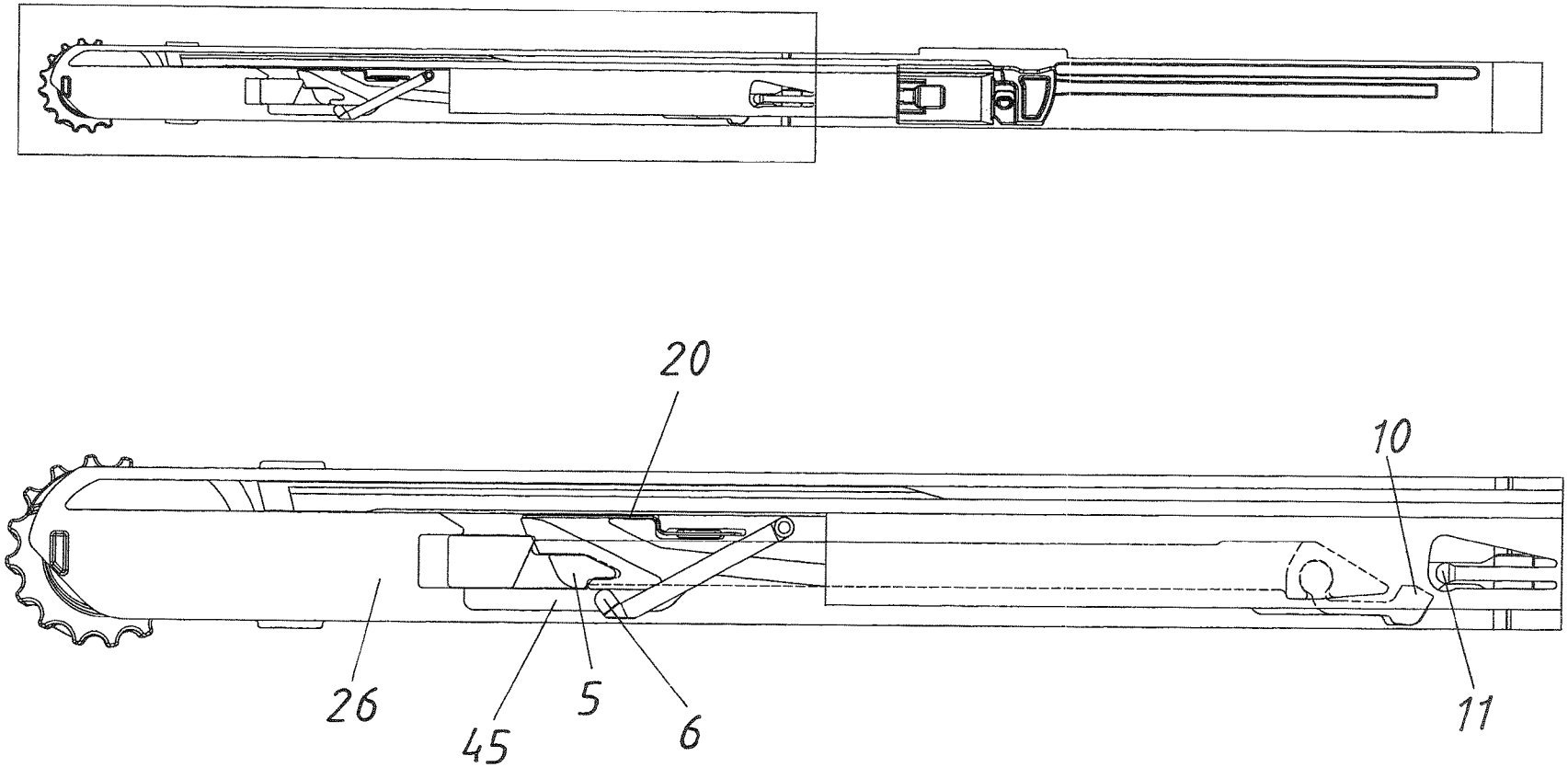
Figure 24:
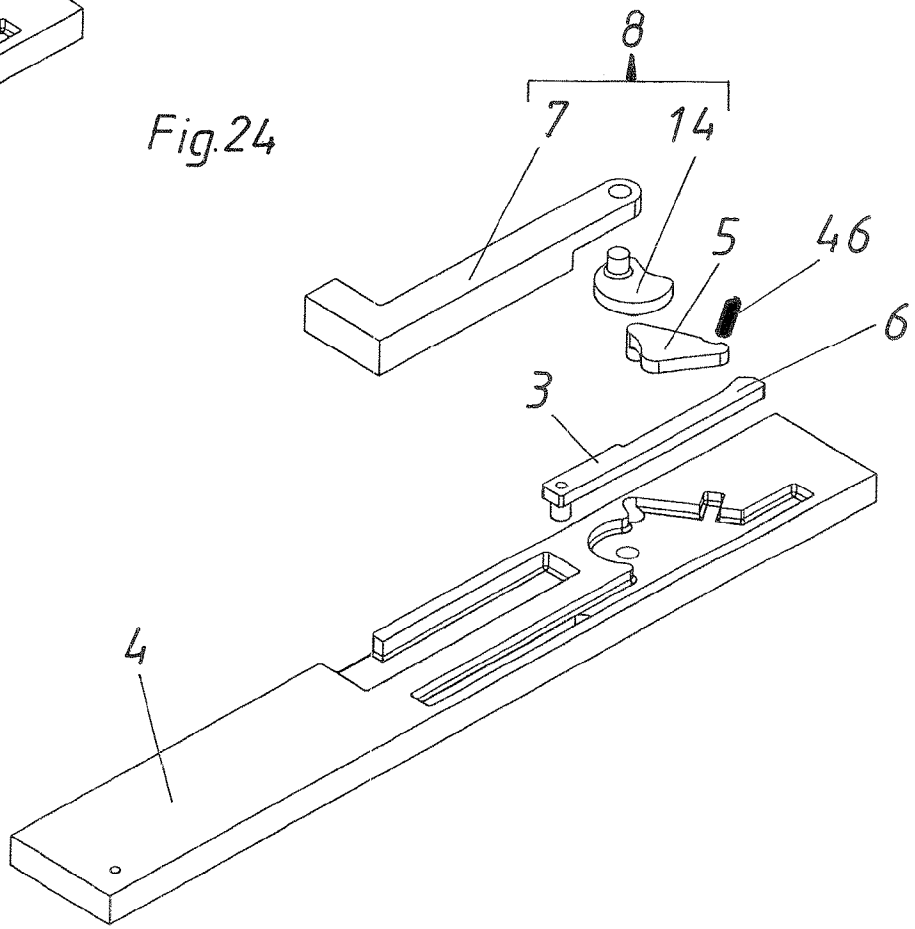
FIGS. 23 through 29 show a second embodiment of a drive device with travel-controlled triggering.
Figure 23:
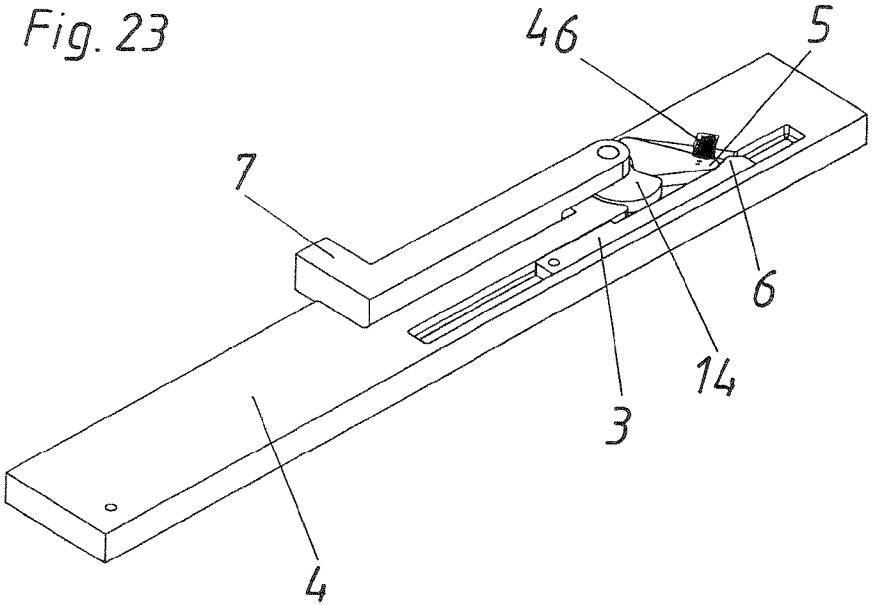

As a further consequence, as shown in FIG. 22, the ejection force storage member 18 can be relieved of stress again and, by way of the ejection slide 3 and the retraction slide 15 held thereto, moves the moveable furniture part in the opening direction OR. As soon as the ejection force storage member 18 has completely relaxed, the retraction force storage member 19 is loaded with the further momentum of the moveable furniture part 2 or by actively pulling on the moveable furniture part 2 in the opening direction OR until the first coupling position K1 between the retraction slide 15 and the ejection slide 3 is regained. Upon closure of the moveable furniture part 2 then as a further consequence the ejection force storage member 18 is stressed before the locking position or the second coupling position K2 is reached. That substantially corresponds to the first movement portion B1 which is between the positions shown in FIG. 13 and FIG. 14.

FIGS. 23 through 29 show a second embodiment of the travel-controlled triggering or unlocking of the latching element 6. In that case, on the housing 4 the ejection slide 3 is acted upon in the opening direction by an ejection force storage member 18 (not shown). At the end of the ejection slide 3, the latching element 6 is formed by a widened portion. The detection device 7 which bears directly or indirectly against the moveable furniture part 2, with the transmission slide 14 in the form of a rotary element, forms the transmission device 8. The rotary element bears against the locking element 5 which is acted upon by the locking spring 46.

Figure 25:
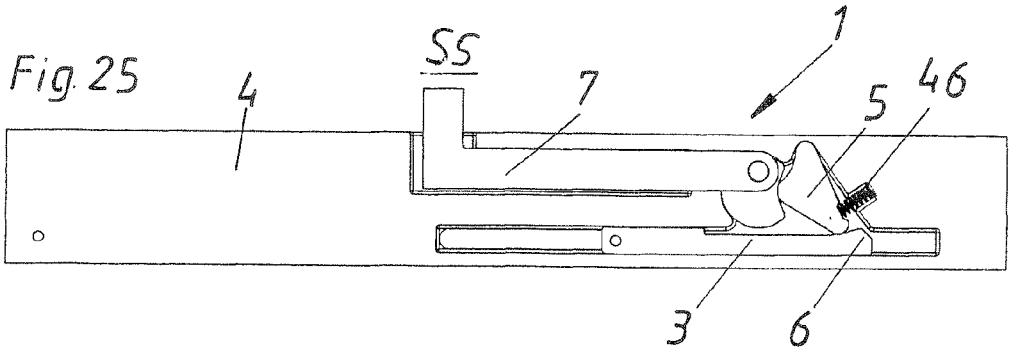

FIG. 25 shows that drive device 1 in the closed position SS, and the locking element 5 bears against the point, closest to the axis of rotation, of the rotary element. Thus the spring 46 is substantially relieved of stress and the locking element 5 holds the ejection slide 3 by way of the latching element 6 in frictionally locking or positively locking relationship.

Figure 26:
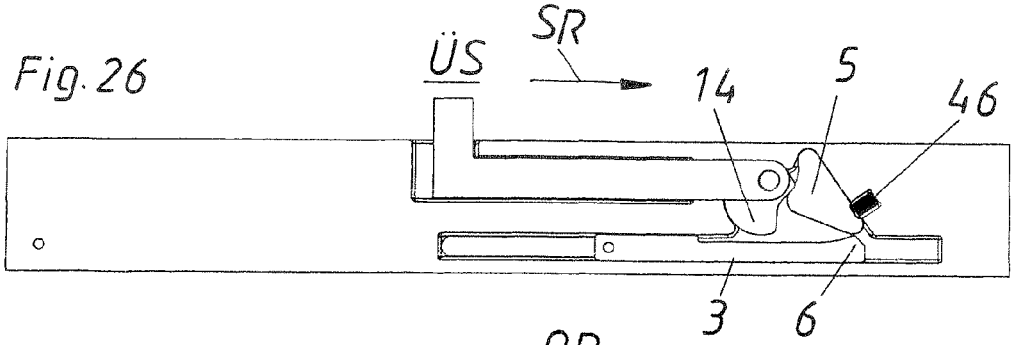

If as shown in FIG. 26 a pressing force is applied to the detection device 7 in the closing direction SR, then the rotary element is rotated in the clockwise direction by way of the eccentric point of engagement on the rotary element. Thus, the locking element 5 is pivoted in the counter-clockwise direction and against the spring force of the locking spring 46. The latching element 6 is released as a result.

Figure 27:
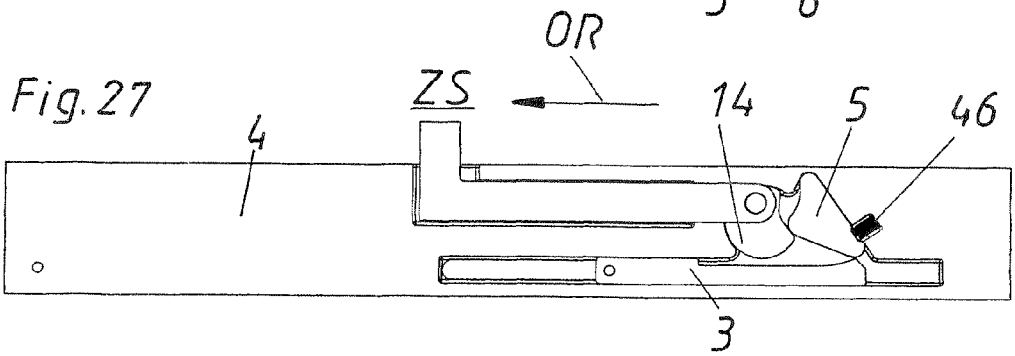

FIG. 27 shows pulling on the moveable furniture part 2 and thus a movement of the detection device 7 in the opening direction OR. As a result, the rotary element moves in the counter-clockwise direction. At the same time, however, the locking element 5 is again moved in the counter-clockwise direction, with release of the latching element 6.

Figure 28:
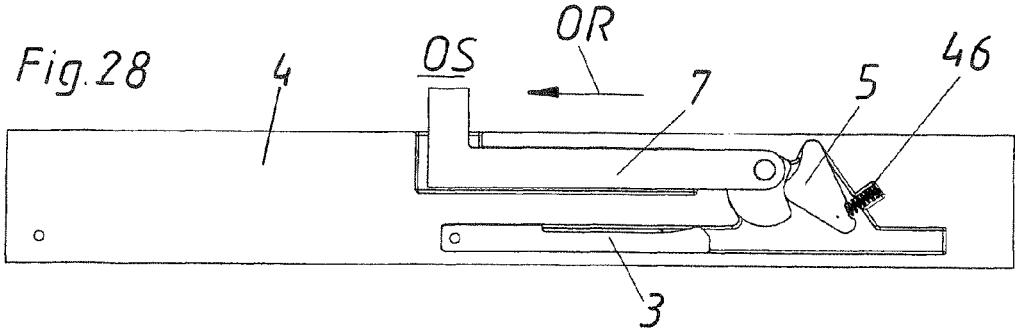

By virtue of that release effect, the ejection force storage member 18 (not shown) can be relieved of stress and moves the ejection element 3 in the opening direction OR, so that the moveable furniture part reaches the open position OS shown in FIG. 28.

Figure 29:
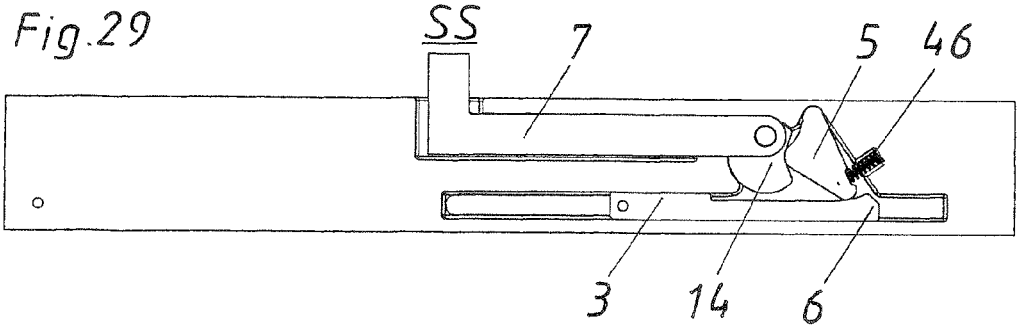

In the closing movement as shown in FIG. 29, the latching element 6 moves with its inclined deflection member over the locking element 5 and passes again into the closed position SS in which the ejection element 3 is locked.

In contrast to the first embodiment, this second embodiment provides that the locking element 5 is moved relative to the housing not only when a pulling force is applied but also in the event of over-pressing, while the latching element 6 respectively remains passive and is only released.

Therefore, that travel-controlled triggering of the latching element 6 provides a possible option, as an alternative to force-controlled triggering, for unlocking the latching element 6 at least when pulling on the moveable furniture part 2 in the opening direction OR.

The invention claimed is:

1. A drive device for driving a moveable furniture part, comprising:

an ejection element configured to act on the moveable furniture part in an opening direction, a housing, a locking element for locking the ejection element, is the locking element being arranged in or on the housing and being moveable relative to the housing, a latching element connected to the ejection element and configured to bear against the locking element in a closed position, the locking element being configured to block a path of the latching element in the opening direction at least in a closed position of the moveable furniture part, the ejection element being configured to be released both upon over-pressing of the moveable furniture part from the closed position in a closing direction and also upon pulling of the moveable furniture part from the closed position in the opening direction, a detection device for detecting a position of the moveable furniture part, and a transmission device separate from the latching element for transmitting the position of the moveable furniture part detected by the detection device, to the locking element, the transmission device being configured to move the locking element upon pulling of the moveable furniture part from the closed position in the opening direction.

2. The drive device as set forth in claim 1, wherein the detection device is configured to be coupled to the moveable furniture part by an entrainment member at least in a part of a path of movement of the moveable furniture part.

3. The drive device as set forth in claim 1, wherein the transmission device has a moveable coupling element configured such that, upon movement of the detection device from the closed position in the opening direction, the transmission device is coupled to a connecting element of the detection device by the coupling element.

4. The drive device as set forth in claim 3, wherein the coupling element is configured such that, upon movement of the detection device in the closing direction, the coupling element can be passed over by the connecting element of the detection device.

5. A drive device as set forth in claim 3, wherein the coupling element of the transmission device is a pivotable coupling element.

6. The drive device as set forth in claim 1, wherein the housing has a cardioid curve-shaped sliding track at least partly therein for engaging the latching element which is mounted movably to the ejection element, wherein the locking element forms at least a part of a latching recess of the sliding track.

7. A drive device as set forth in claim 6, wherein the locking element and a section of the cardioid curve-shaped sliding track form at least a part of a latching recess of the sliding track, the locking element is movable relative to the section of the sliding track.

8. The drive device as set forth in claim 1, wherein the transmission device has a transmission slide mounted moveably in or on the housing.

9. The drive device as set forth in claim 8, wherein the locking element is formed as one piece with the transmission slide.

10. The drive device as set forth in claim 1, further comprising a refraction device for retracting the moveable furniture part from an open position into the closed position.

11. The drive device as set forth in claim 10, wherein the refraction device is part of the detection device.

12. An article of furniture comprising;

a furniture carcass, a moveable furniture part, and the drive device as set forth in claim 1 for driving the moveable furniture part.

* * * * *